US009067447B2

(12) United States Patent
Suzuki et al.

(10) Patent No.: US 9,067,447 B2
(45) Date of Patent: Jun. 30, 2015

(54) INK RIBBON CASSETTE AND PRINTER APPARATUS

(71) Applicant: Canon Kabushiki Kaisha, Tokyo (JP)

(72) Inventors: Masaki Suzuki, Yokohama (JP); Yukiteru Yano, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/475,303

(22) Filed: Sep. 2, 2014

(65) Prior Publication Data

US 2015/0062278 A1 Mar. 5, 2015

(30) Foreign Application Priority Data

Sep. 5, 2013 (JP) ..... 2013-183963
Sep. 5, 2013 (JP) ..... 2013-183964
Sep. 5, 2013 (JP) ..... 2013-183965
Sep. 5, 2013 (JP) ..... 2013-183966

(51) Int. Cl.
*B41J 32/00* (2006.01)
*B41J 2/325* (2006.01)

(52) U.S. Cl.
CPC . *B41J 32/00* (2013.01); *B41J 2/325* (2013.01)

(58) Field of Classification Search
USPC ..... 347/211, 213–215, 217–219, 222, 16, 347/171, 197, 198; 400/611, 613, 618, 621; 271/3.14, 3.18, 3.2
See application file for complete search history.

(56) References Cited

U.S. PATENT DOCUMENTS 7,079,167 B2 * 7/2006 Hayashi ..... 347/214
8,382,389 B2 * 2/2013 Yamaguchi et al. ..... 347/214
2011/0043590 A1 * 2/2011 Penzo ..... 347/217

FOREIGN PATENT DOCUMENTS

JP 2001-205881 A 7/2001

* cited by examiner

*Primary Examiner* — Kristal Feggins
(74) *Attorney, Agent, or Firm* — Canon U.S.A., Inc. IP Division

(57) ABSTRACT

An ink ribbon cassette includes an elastic engaging portion configured to engage with a rotation regulating portion of a supply bobbin or a rotation regulating portion of a winding bobbin to regulate rotation of the supply bobbin or the winding bobbin. The elastic engaging portion is elastically deformable in a direction of rotation axes of the supply bobbin and the winding bobbin.

30 Claims, 17 Drawing Sheets

INK RIBBON CASSETTE AND PRINTER APPARATUS

BACKGROUND OF THE INVENTION

1. Field of the Invention

The present invention relates to an ink ribbon cassette to be attached to a printer and a printer to which an ink ribbon cassette can be attached.

2. Description of the Related Art

A dye sublimation printer prints images by bringing a recording medium such as a sheet into pressure contact with an ink ribbon by use of a thermal head and a platen roller and then energizing the thermal head to cause heating elements on the thermal head to generate heat so that a dye applied to the ink ribbon sublimates to transfer onto the sheet.

To facilitate attachment or removal of the ink ribbon to or from a printer body, a cylindrical supply bobbin around which the ink ribbon is wound and a cylindrical winding bobbin are contained in an ink ribbon cassette. In the ink ribbon cassette, the supply bobbin and the winding bobbin are rotatably held. When the ink ribbon cassette is attached to the printer body, the thermal head is positioned between the supply bobbin and the winding bobbin. With the ink ribbon and the sheet being overlapped, the thermal head is brought into pressure contact with the platen roller and driven to print images.

Before the ink ribbon cassette is attached to the printer body for use, external vibrations may be applied to the rink ribbon cassette due to transportation or the like. The vibrations applied to the ink ribbon cassette can cause the ink ribbon wound around the supply bobbin or the winding bobbin to loosen and be pulled out of the ink ribbon cassette. This necessitates preventing the supply bobbin and the winding bobbin in the ink ribbon cassette from rotating when the ink ribbon cassette is not attached to the printer body.

Japanese Patent Application Laid-Open No. 2001-205881 discusses an ink ribbon cassette that regulates rotation of a supply bobbin and a winding bobbin by engaging projecting portions of inner walls of the ink ribbon cassette with depressed portions of end surface portions of the supply bobbin and the winding bobbin. In Japanese Patent Application Laid-Open No. 2001-205881, a mold piece provided in the ink ribbon cassette biases the supply bobbin and the winding bobbin in an axial direction so that the depressed portions are engaged with the projecting portions to regulate the rotation of the supply bobbin and the winding bobbin. When the ink ribbon cassette is in use, the supply bobbin and the winding bobbin are pressed in the axial direction to release the regulation of the rotation.

In the conventional technique discussed in Japanese Patent Application Laid-Open No. 2001-205881, however, since the supply bobbin and the winding bobbin are slid by a resin spring such as the mold piece, if the volume of the ink ribbon wound around the bobbins increases to increase the weight of the ink ribbon, the load applied to the resin spring increases. This can easily cause the resin spring to be damaged or distorted, and necessitates a mold with greater strength.

Furthermore, since the supply bobbin and the winding bobbin around which the ink ribbon is wound are moved by sliding, the ink ribbon can be wrinkled, and the wrinkles can affect the printing.

SUMMARY OF THE INVENTION

According to an aspect of the present invention, an ink ribbon cassette includes a supply bobbin around which an ink ribbon is wound, a winding bobbin configured to wind the ink ribbon supplied by the supply bobbin, a housing configured to support the supply bobbin and the winding bobbin in such a manner that the supply bobbin and the winding are substantially parallel to each other and are rotatable, and an engaging member configured to engage with a rotation regulating portion of the supply bobbin or a rotation regulating portion of the winding bobbin to regulate rotation of the supply bobbin or the winding bobbin, and to be elastically deformable in a direction of rotation axes of the supply bobbin and the winding bobbin.

Further features of the present invention will become apparent from the following description of exemplary embodiments with reference to the attached drawings.

DESCRIPTION OF THE EMBODIMENTS

A printer body and an ink ribbon cassette according to a first exemplary embodiment will be described with reference to FIGS. 1 to 15.

Figure 1:
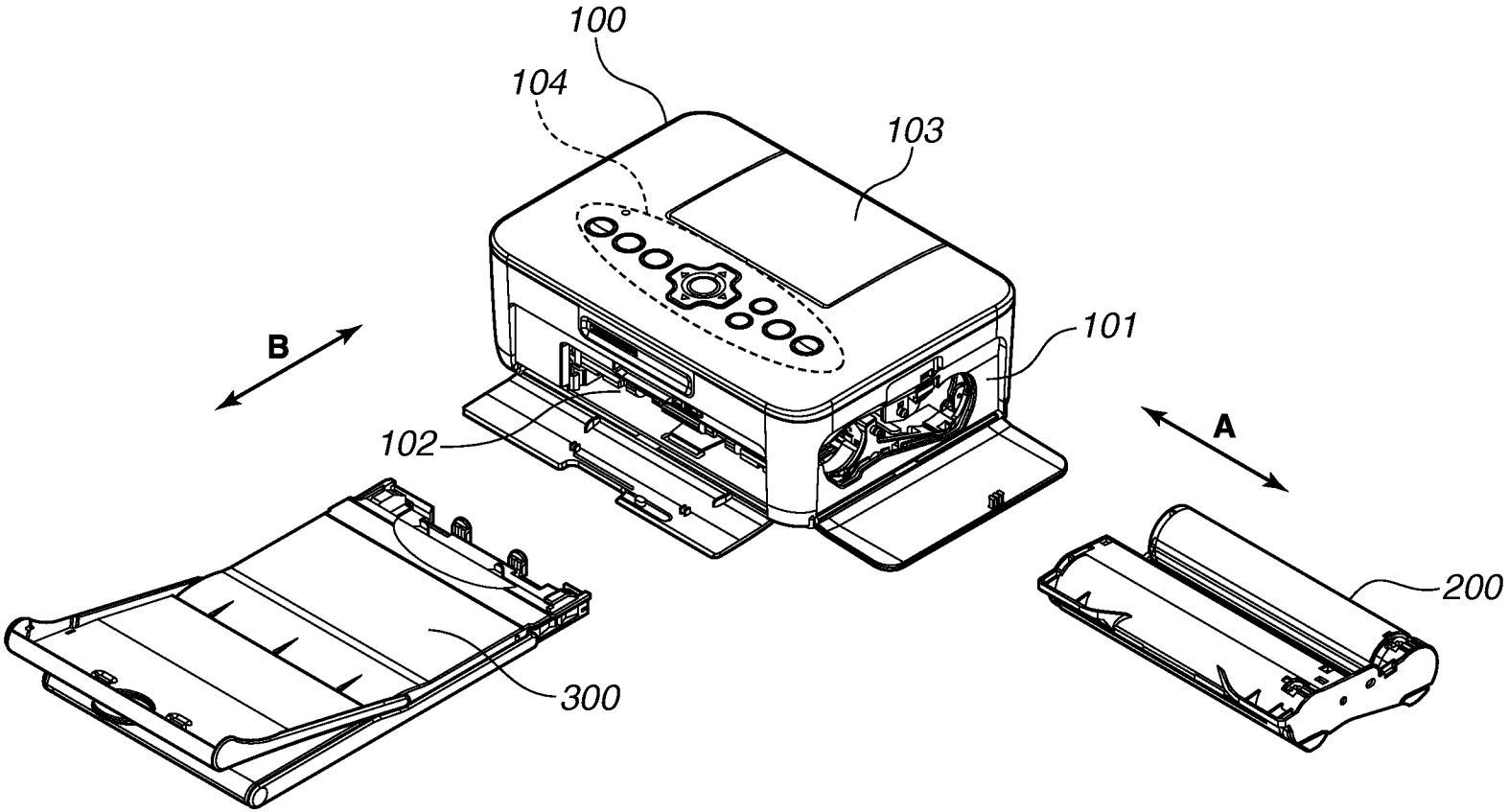
FIG. 1 is a perspective view illustrating a printer body and an ink ribbon cassette in their entirety.

FIG. 1 is a perspective view illustrating the printer body and the ink ribbon cassette according to the present exemplary embodiment in their entirety.

FIG. 1 includes a printer body 100, an ink ribbon cassette 200, and a sheet tray 300. A side surface of the printer body 100 includes an ink ribbon cassette insertion opening 101 via which the ink ribbon cassette 200 can be attached. The ink ribbon cassette 200 can be attached or removed in the direction of an arrow A. The arrow A indicates a direction that is horizontal to rotation axes of a supply bobbin 205 and a winding bobbin 207 contained in the ink ribbon cassette 200. A cover 105 for the ink ribbon cassette insertion opening 101 is rotatably attached so that it can be freely opened or closed.

A front surface of the printer body 100 includes a sheet tray insertion opening 102 via which the sheet tray 300 can be attached. The sheet tray 300 can be attached or removed in the direction of an arrow B.

A top surface of the printer body 100 includes a display unit 103 and an operation unit 104. The display unit 103 includes a display means such as a liquid crystal display (LCD). The display unit 103 displays an image to be printed, image processing information, and the like, and the user operates the operation unit 104 to select an image, process the image as appropriate, and print the image.

Figure 2A:
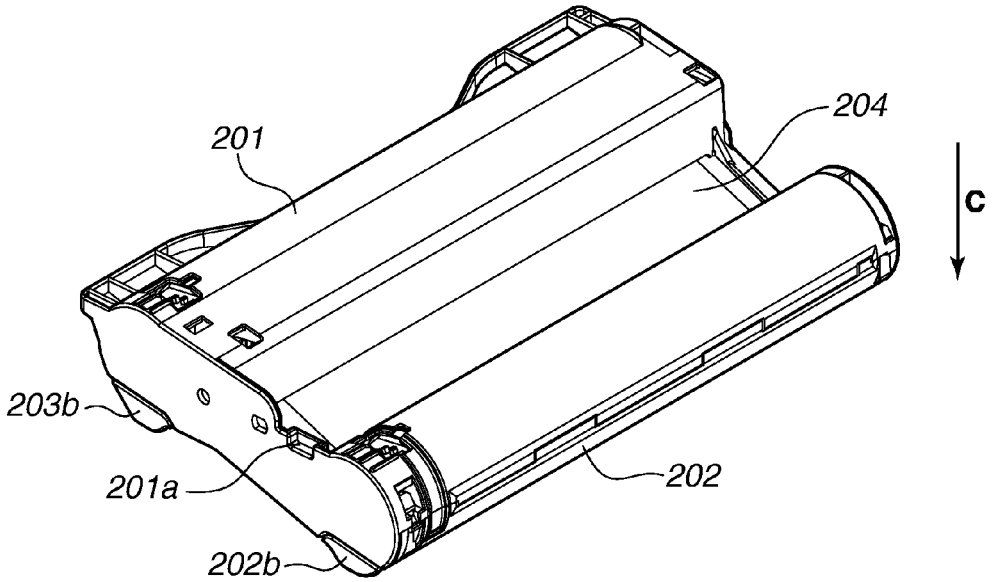
FIGS. 2A and 2B are perspective views illustrating the ink ribbon cassette.
Figure 2B:
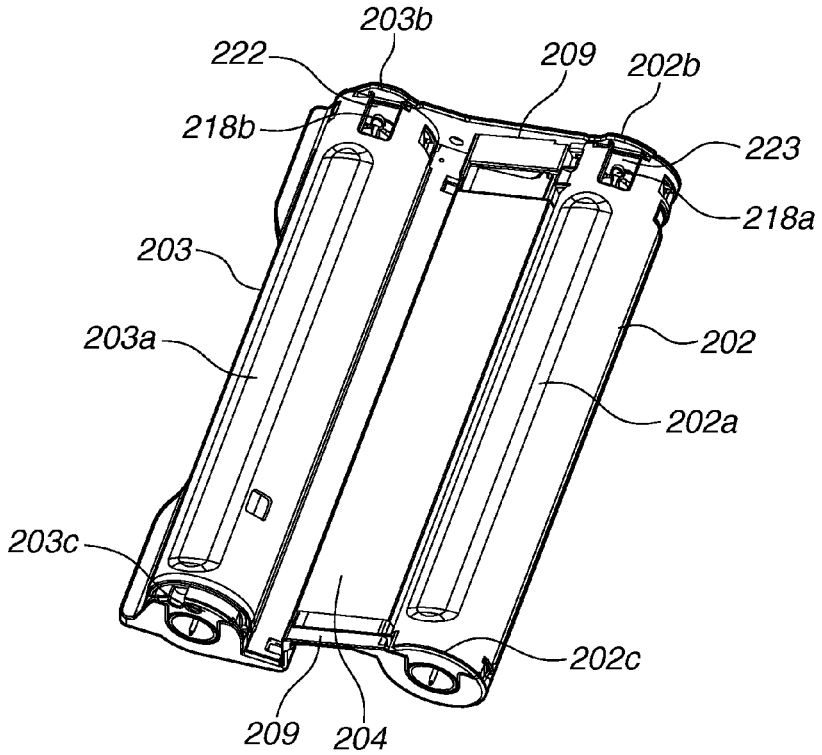
Figure 3A:
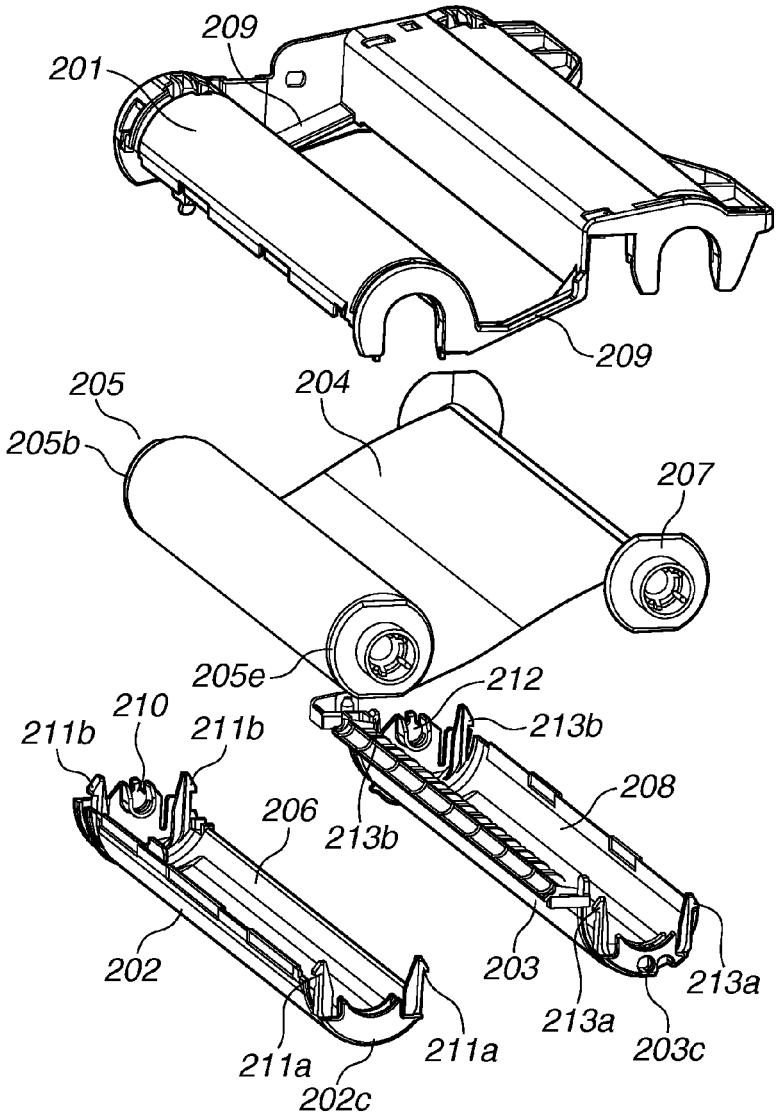
FIGS. 3A and 3B are exploded perspective views illustrating the ink ribbon cassette.
Figure 3B:
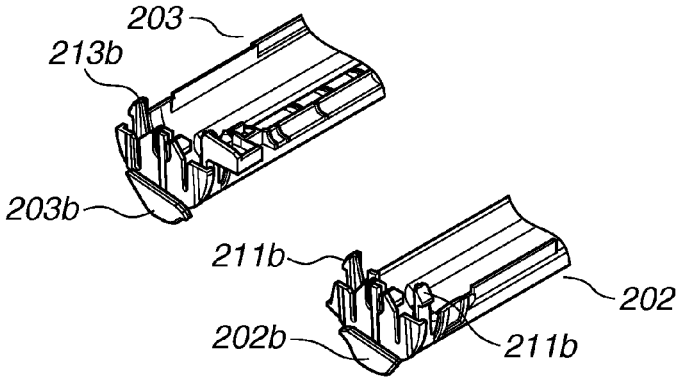
Figure 4A:
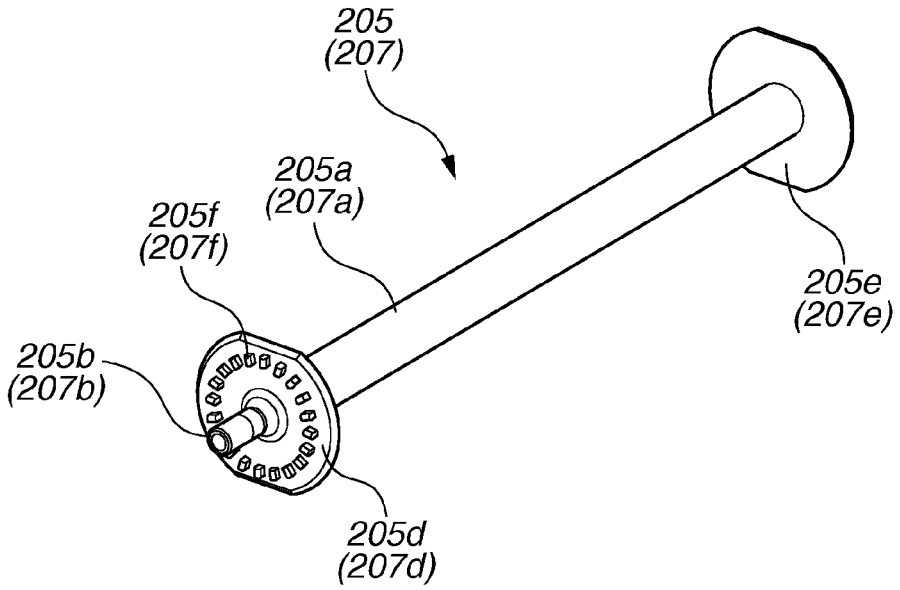
FIGS. 4A and 4B are perspective views illustrating a supply bobbin (winding bobbin).
Figure 4B:
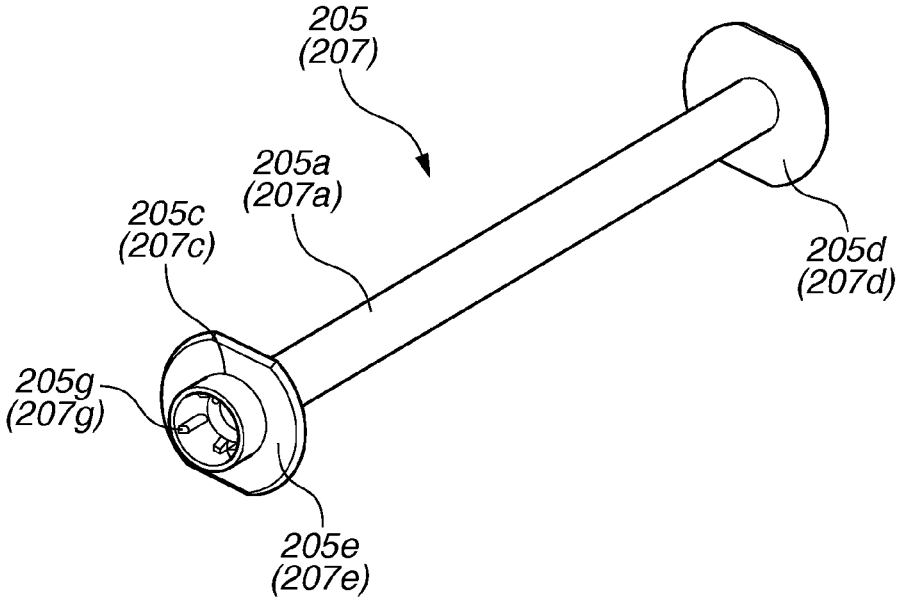

FIGS. 2A and 2B are perspective views illustrating the ink ribbon cassette 200. FIG. 2A is a perspective view illustrating the ink ribbon cassette 200 viewed from a top surface. FIG. 2B is a perspective view illustrating the ink ribbon cassette 200 viewed from a bottom surface. FIG. 3A is an exploded perspective view illustrating the ink ribbon cassette 200. FIG. 3B is a perspective view illustrating a first lower case 202 and a second lower case 203. FIGS. 4A and 4B are perspective views illustrating the supply bobbin 205 (winding bobbin 207).

As illustrated in FIGS. 2A, 2B, 3A, and 3B, a housing portion of the ink ribbon cassette 200 includes an upper case 201, the first lower case 202, and the second lower case 203. The upper case 201, the first lower case 202, and the second lower case 203 are made of resin.

As illustrated in FIGS. 2A and 3B, the first lower case 202 includes a first bottom surface 202*a* and a first side wall 202*b*. The first side wall 202*b* has a projecting shape and forms a part of a side surface of the ink ribbon cassette 200 that is substantially orthogonal to the rotation axes of the supply bobbin 205 and the winding bobbin 207. The side opposite to the first side wall 202*b* includes a first corner portion 202*c*.

Similarly, the second lower case 203 includes a second bottom surface 203*a* and a second side wall 203*b*. The second side wall 203*b* has a projecting shape and forms a part of the side surface of the ink ribbon cassette 200 that is substantially orthogonal to the rotation axes of the supply bobbin 205 and the winding bobbin 207. The side opposite to the second side wall 203*b* includes a second corner portion 203*c*.

The ink ribbon cassette 200 includes a supply bobbin containing unit 206 and a winding bobbin containing unit 208. The supply bobbin containing unit 206 contains the supply bobbin 205, which supplies the ink ribbon 204. The winding bobbin containing unit 208 contains the winding bobbin 207, which winds the ink ribbon 204. Both end portions of the supply bobbin containing unit 206 and the winding bobbin containing unit 208 are connected together by connecting portions 209 and disposed so that the rotation axes of the supply bobbin containing unit 206 and the winding bobbin containing unit 208 are parallel to each other with a predetermined space between the supply bobbin containing unit 206 and the winding bobbin containing unit 208.

The first bottom surface 202*a* of the first lower case 202 and the second bottom surface 203*a* of the second lower case 203 are surfaces that are substantially parallel to the rotation axes of the supply bobbin 205 and the winding bobbin 207, respectively. Further, the first side wall 202*b* of the first lower case 202 and the second side wall 203*b* of the second lower case 203 are surfaces that are substantially orthogonal to the rotation axes of the supply bobbin 205 and the winding bobbin 207, respectively.

As illustrated in FIG. 3A, the first lower case 202 includes the supply bobbin containing unit 206. A supply bobbin bearing portion 210 is provided inside the supply bobbin containing unit 206. The supply bobbin bearing portion 210 rotatably supports the supply bobbin 205. End portions of the first lower case 202 include a pair of engaging claw portions 211*a* and a pair of engaging claw portions 211*b*, respectively, to engage with the upper case 201. The second lower case 203 includes the winding bobbin containing unit 208. A winding bobbin bearing portion 212 is provided inside the winding bobbin containing unit 208. The winding bobbin bearing portion 212 rotatably supports the winding bobbin 207. End portions of the second lower case 203 include a pair of engaging claw portions 213*a* and a pair of engaging claw portions 213*b*, respectively, to engage with the upper case 201.

As illustrated in FIGS. 3A, 4A, and 4B, the supply bobbin 205 and the winding bobbin 207 have the same shape and are made of resin. The supply bobbin 205 includes a cylindrical base portion 205*a* provided at the center, a small-diameter portion 205*b* provided at one end of the base portion 205*a*, and a large-diameter portion 205*c* provided at another end of the base portion 205*a*. The winding bobbin 207 includes a cylindrical base portion 207*a* provided at the center, a small-diameter portion 207*b* provided at one end of the base portion 207*a*, and a large-diameter portion 207*c* provided at another end of the base portion 207*a*. The small-diameter portions 205*b* and 207*b* are freely rotatably supported by the supply bobbin bearing portion 210 of the first lower case 202 and the winding bobbin bearing portion 212 of the second lower case 203, respectively, to freely rotatably support the supply bobbin 205 and the winding bobbin 207.

First flange portions 205*d* and 207*d* are provided at boundaries between the small-diameter portions 205*b* and 207*b* and the base portions 205*a* and 207*a*, respectively. Second flange portions 205*e* and 207*e* are provided at boundaries between the large-diameter portions 205*c* and 207*c* and the base portions 205*a* and 207*a*, respectively. Outer surfaces of the first flange portions 205*d* and 207*d* include a plurality of rotation regulating portions 205*f* and 207*f*, respectively. Each of the multiple rotation regulating portions 205*f* and 207*f* has a projecting shape. The plurality of rotation regulating portions 205*f* and 207*f* are evenly spaced in circumferential directions of the axes, respectively.

As illustrated in FIG. 3A, the ink ribbon 204 is wound between the first flange portion 205*d* and the second flange portion 205*e*.

Inside wall surfaces of the large-diameter portions 205*c* and 207*c* include projecting portions 205*g* and 207*g*, respectively. The projecting portions 205*g* and 207*g* engage with bobbin rotation driving portions (not illustrated) of the printer body 100 to rotationally drive the supply bobbin 205 and the winding bobbin 207.

Figure 5A:
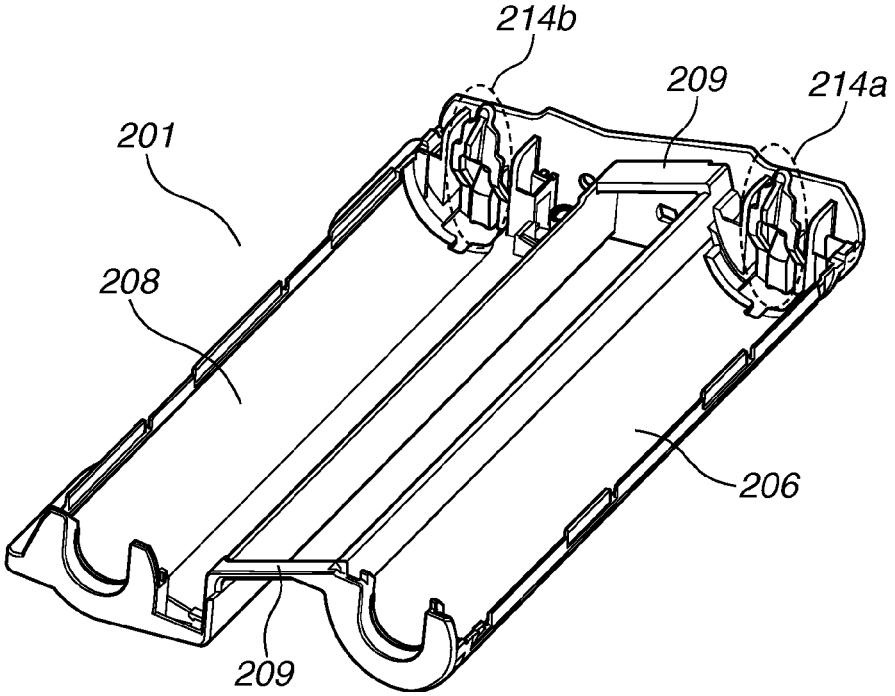
FIGS. 5A and 5B are perspective views illustrating an upper case.
Figure 5B:
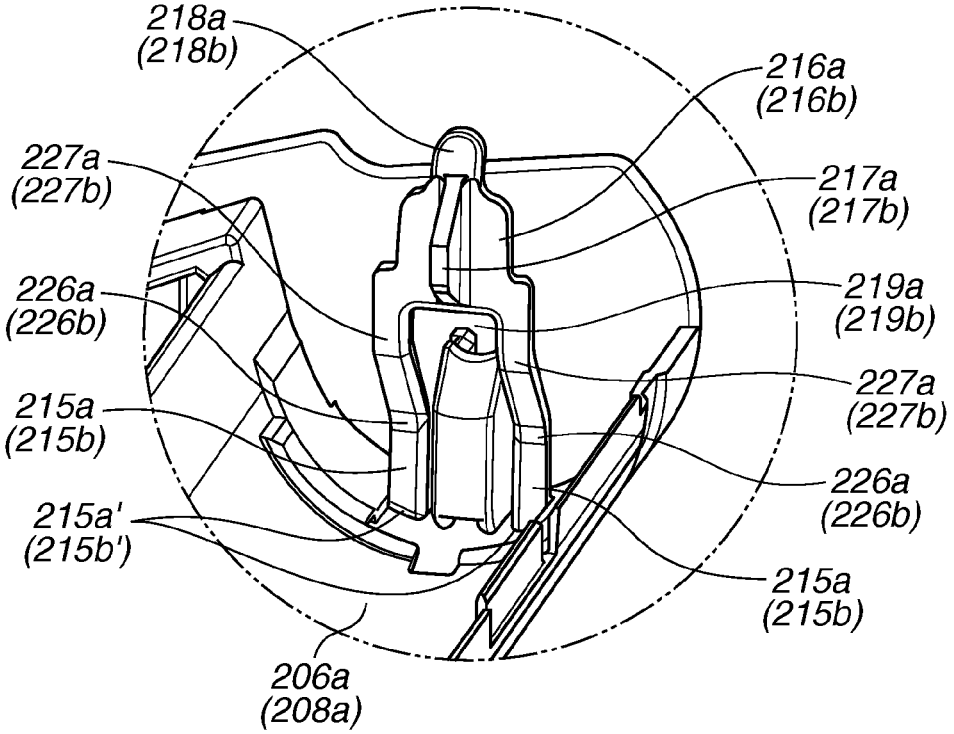
Figure 6:
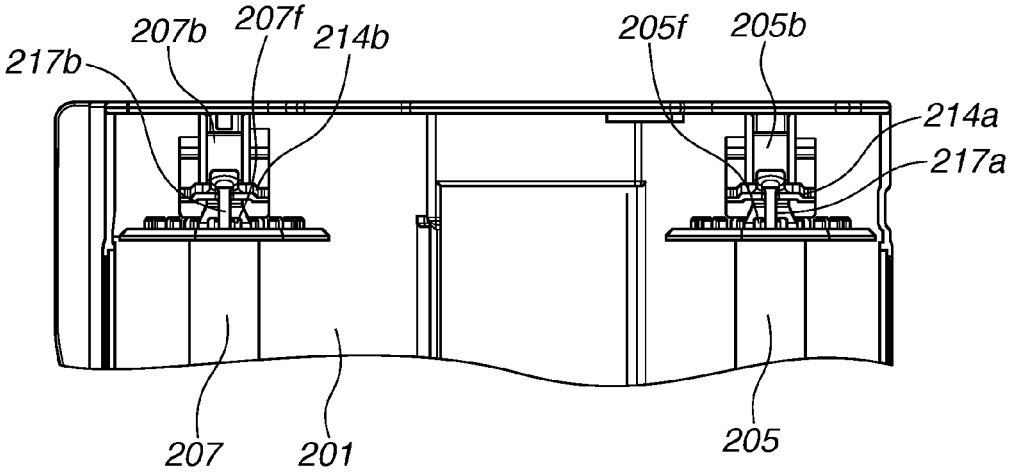
FIG. 6 is a top view illustrating the upper case to which the supply bobbin and the winding bobbin are attached.

FIG. 5A is a perspective view illustrating the upper case 201. FIG. 5B is an enlarged view of a part of the upper case 201. FIG. 6 is a top view illustrating the upper case 201 to which the supply bobbin 205 and the winding bobbin 207 are attached.

As illustrated in FIG. 5A, elastic engaging elements 214*a* and 214*b* are formed integrally with an inside wall portion of the upper case 201. The elastic engaging elements 214*a* and 214*b* have substantially the same shape. FIG. 5B illustrates the elastic engaging element 214*a*, reference numerals of corresponding portions of the elastic engaging element 214*b* are also specified in the parentheses, as the elastic engaging element 214*b*, which has substantially the same shape, has a similar shape.

As illustrated in FIG. 5B, the elastic engaging element 214*a* (214*b*) includes an elastically deformable arm portion 215*a* (215*b*), a middle portion 216*a* (216*b*), an engaging portion 217*a* (217*b*), and a leading edge contact portion 218*a* (218*b*). The arm portion 215*a* (215*b*) has a two-pronged shape, and a central space portion 219*a* (219*b*) is formed in the arm portion 215*a* (215*b*). The arm portion 215*a* (215*b*) includes a first bending portion 226*a* (226*b*) and a second bending portion 227*a* (227*b*). In this way, a plurality of bending points are provided, so that stress applied due to elastic deformation can be spread over the plurality of bending points to prevent plastic deformation to a shape formed by the bending. Furthermore, forming the bending portions increases the length of the arm forming a joist to produce an advantage that creeping is less likely to occur.

The elastic engaging element 214*a* (214*b*) is symmetrical about the central space portion 219*a* (219*b*).

The elastic engaging element 214*a* (214*b*) is a part of the upper case 201 and is integrally molded with resin as a part of the upper case 201. The elastic engaging element 214*a* (214*b*) is formed to rise at a substantially right angle towards the inside of the supply bobbin containing unit 206 (bobbin containing unit 208) from a top surface 206*a* (208*a*), which forms the supply bobbin containing unit 206 (bobbin containing unit 208) and is a surface parallel to the axis of the supply bobbin 205 (winding bobbin 207). Accordingly, when the elastic engaging element 214*a* (214*b*) is elastically deformed, the leading edge contact portion 218*a* (218*b*) is moved to draw an arc centered at a base portion 215*a*' (215*b*') of the arm portion 215*a* (215*b*). The base portion 215*a*' (215*b*') is a rise portion from the top surface 206*a* (208*a*).

FIG. 2B illustrates the upper case 201 to which the first lower case 202 and the second lower case 203 are attached. In this state, the leading edge contact portions 218*a* and 218*b* of the elastic engaging elements 214*a* and 214*b* respectively project through opening portions 222 and 223 of the first lower case 202 and the second lower case 203. The opening portions 222 and 223 are formed in a side surface of one end of the ink ribbon cassette 200.

As illustrated in FIG. 6, when the supply bobbin 205 is attached to the upper case 201, the small-diameter portion 205*b*, which becomes the rotation axis of the supply bobbin 205, comes into the central space portion 219*a*. Similarly, the small-diameter portion 207*b*, which becomes the rotation axis of the winding bobbin 207, comes into the central space portion 219*b* when the winding bobbin 207 is attached to the upper case 201. The engaging portions 217*a* and 217*b* of the upper case 201 engage with the rotation regulating portions 205*f* and 207*f* of the supply bobbin 205 and the winding bobbin 207, respectively, to regulate the rotation of the supply bobbin 205 and the winding bobbin 207.

As illustrated in FIGS. 5A, 5B, and 6, the elastic engaging element 214*a* has the two-pronged shape, so that the length of the elastic engaging element 214*a* can be increased. Furthermore, the rotation axis of the supply bobbin 205 is arranged to be positioned in the central space portion 219*a* between the two prongs of the arm portion 215*a*, so that regardless of the direction in which the supply bobbin 205 is rotated, the strength of the elastic engaging element 214 with respect to the rotation of the supply bobbin 205 can be ensured.

Figure 7:
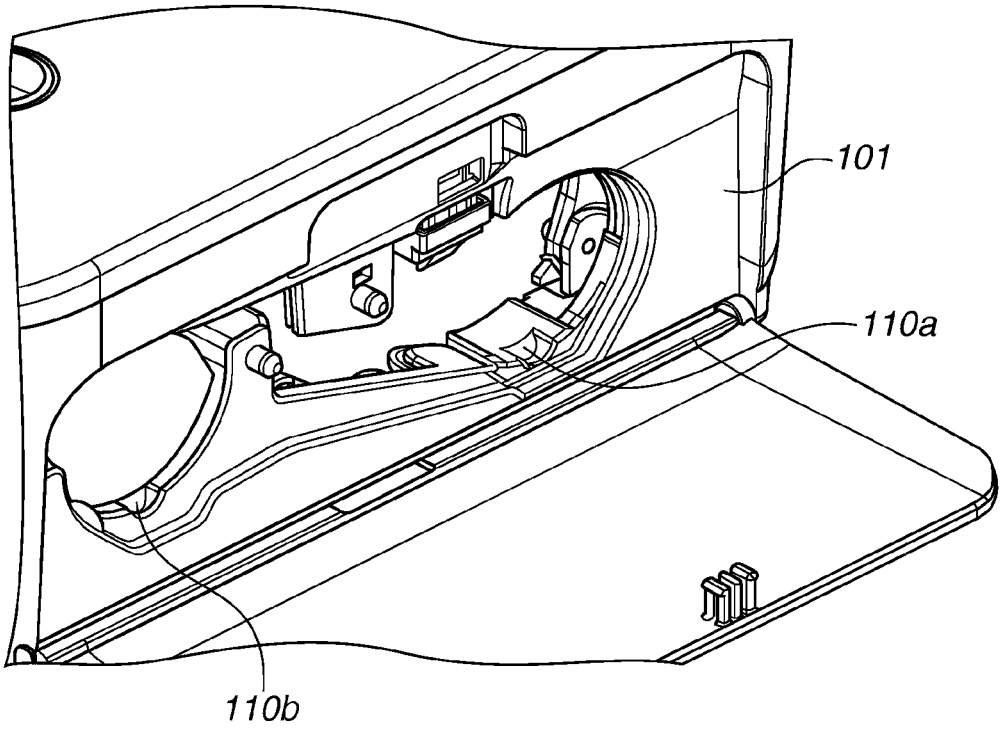
FIG. 7 is a side view illustrating the printer body.

FIG. 7 is an enlarged view of a part of the ink ribbon cassette insertion opening 101 of the printer body 100.

The ink ribbon cassette insertion opening 101 includes contact surfaces 110*a* and 110*b* with which the leading edge contact portions 218*a* and 218*b* of the ink ribbon cassette 200 come into contact when the ink ribbon cassette 200 is attached to the printer body 100.

Figure 8A:
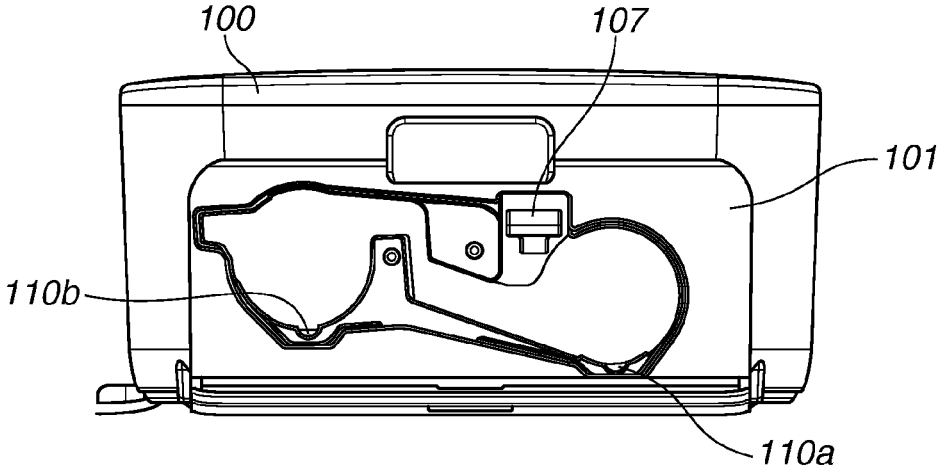
FIGS. 8A, 8B, and 8C are side views illustrating the printer body.
Figure 8B:
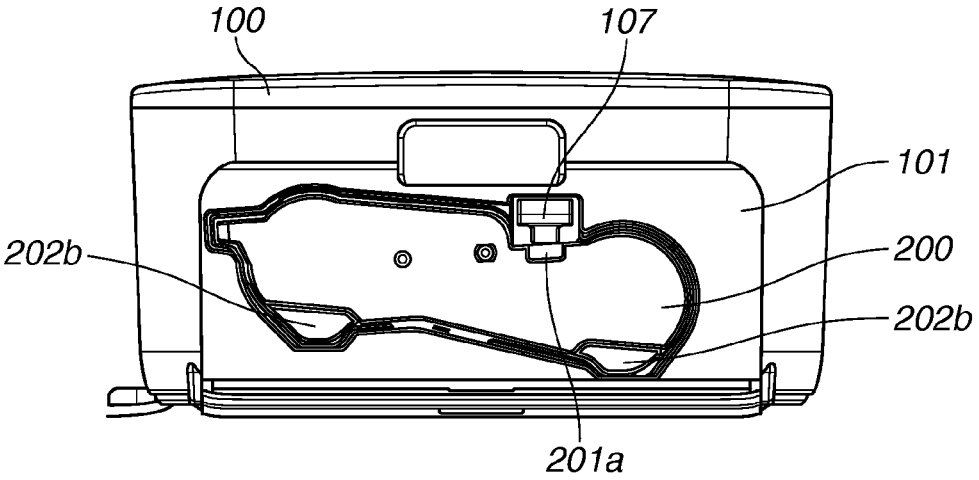
Figure 8C:
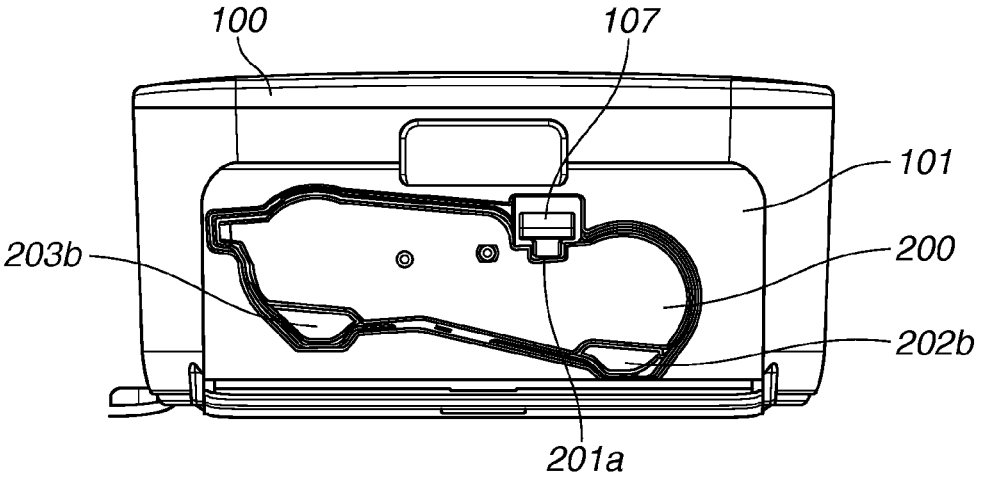

FIGS. 8A, 8B, and 8C are side views illustrating the printer body 100. FIG. 8A is a side view illustrating the printer body 100 to which no ink ribbon cassette 200 is attached. FIG. 8B is a side view illustrating the printer body 100 immediately before the ink ribbon cassette 200 is attached to the printer body 100. FIG. 8C is a side view illustrating the printer body 100 to which the ink ribbon cassette 200 has been attached.

FIGS. 8A, 8B, and 8C include a cassette lock 107 and the contact surfaces 110*a* and 110*b*. The cassette lock 107 is disposed at the ink ribbon cassette insertion opening 101 so that the cassette lock 107 can be moved from the position specified in FIG. 8A to the position specified in FIG. 8B. The cassette lock 107 is always biased downward, i.e., the direction of the first side wall 202*b* and the leading edge contact portion 218*a*.

As illustrated in FIG. 8B, when the ink ribbon cassette 200 is attached to the printer body 100, the cassette lock 107 is pushed upward by the ink ribbon cassette 200. Then, when the ink ribbon cassette 200 is attached to the printer body 100, the cassette lock 107 engages with a body engaging portion 201*a* of the ink ribbon cassette 200 as illustrated in FIG. 8C, and the ink ribbon cassette 200 is maintained in the state in which the ink ribbon cassette 200 is attached to the printer body 100.

To remove the ink ribbon cassette 200 from the printer body 100, the cassette lock 107 is pushed upward from a locked position illustrated in FIG. 8C to a release position illustrated in FIG. 8B, so that the ink ribbon cassette 200 can be removed from the printer body 100.

The contact surfaces 110*a* and 110*b* are surfaces with which the leading edge contact portions 218*a* and 218*b* of the ink ribbon cassette 200 come into contact when the ink ribbon cassette 200 is attached to the printer body 100.

Figure 9A:
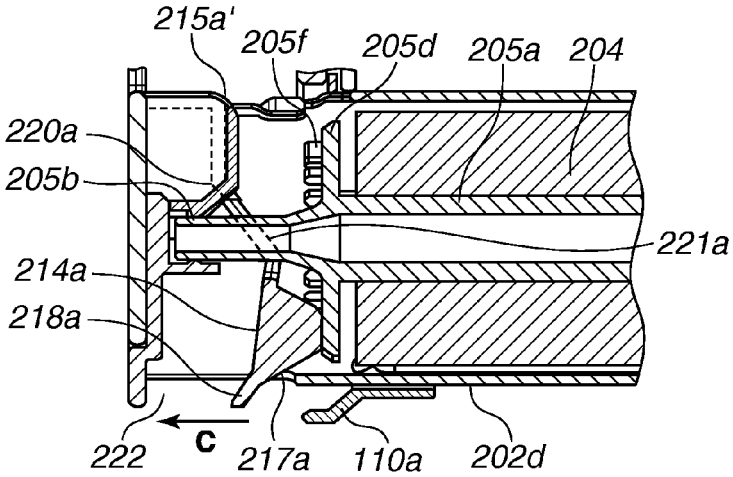
FIGS. 9A, 9B, and 9C are cross sectional views illustrating an operation of attaching the ink ribbon cassette to the printer body.
Figure 9B:
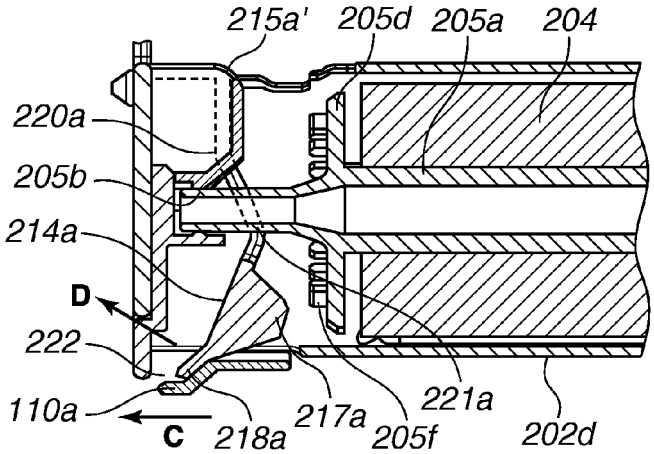
Figure 9C:
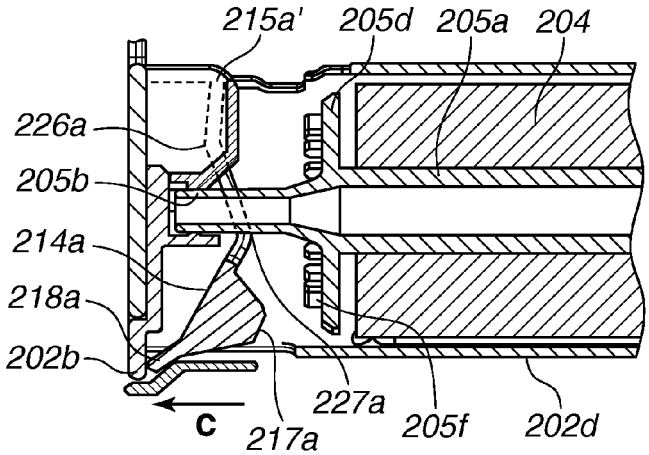

FIGS. 9A, 9B, and 9C are cross sectional views illustrating an operation of attaching the ink ribbon cassette 200 to the printer body 100. FIG. 9A is a cross sectional view illustrating the printer body 100 immediately before the ink ribbon cassette 200 is attached to the printer body 100. FIG. 9B is a cross sectional view illustrating the printer body 100 to which the ink ribbon cassette 200 is attached. FIG. 9C is a cross sectional view illustrating the case in which external force is applied to the elastic engaging element 214*a* of the ink ribbon cassette 200 attached to the printer body 100.

As illustrated in FIG. 9A, before the ink ribbon cassette 200 is attached to the printer body 100, the rotation regulating portion 205*f* of the supply bobbin 205 is engaged with the engaging portion 217*a* of the upper case 201 to regulate the rotation of the supply bobbin 205.

Then, when the ink ribbon cassette 200 is attached to the printer body 100, the leading edge contact portion 218*a* projecting through the opening portion 222 of the first lower case 202 comes into contact with the contact surface 110*a* of the printer body 100, as illustrated in FIG. 9B. Consequently, the elastic engaging element 214*a* is elastically deformed toward the direction of an arrow C (thrust direction) illustrated in FIG. 9B to disengage the engaging portion 217*a* from the rotation regulating portion 205*f* of the supply bobbin 205 so that the supply bobbin 205 becomes freely rotatable. The rotation regulation of the winding bobbin 207 is also released when the ink ribbon cassette 200 is attached to the printer body 100.

In other words, when the ink ribbon cassette 200 is attached to the printer body 100, the rotation regulation of the supply bobbin 205 and the rotation of the winding bobbin 207 are released so that the ink ribbon 204 in the ink ribbon cassette 200 can be transported. The direction of the arrow C refers to the thrust direction of the supply bobbin 205, i.e., the direction of the rotation axis of the supply bobbin 205.

When the rotation regulation of the supply bobbin 205 and the rotation of the winding bobbin 207 are released, the elastic engaging element 214*a* is elastically deformed in the direction of the arrow C illustrated in FIGS. 9A to 9C, so that reaction force toward the direction of an arrow D illustrated in FIG. 9B is applied to the ink ribbon cassette 200 to push the ink ribbon cassette 200 upward. To facilitate smooth attachment of the ink ribbon cassette 200 to the printer body 100, the outer shape of the ink ribbon cassette 200 is smaller than the ink ribbon cassette insertion opening 101, as illustrated in FIG. 8C. Thus, the ink ribbon cassette 200 and the ink ribbon cassette insertion opening 101 have a space therebetween. Further, the contact surfaces 110*a* and 110*b* are provided on the lower side of the insertion opening 101, whereas the ink ribbon cassette 200 is provided on the upper side of the insertion opening 101. That is to say, the contact surfaces 110*a* and 110*b* and the ink ribbon cassette 200 are provided on the opposite sides of the insertion opening 101. Accordingly, when the ink ribbon cassette 200 is pushed upward (toward the cassette lock 107 of the printer body 100), the body engaging portion 201*a* of the ink ribbon cassette 200 comes near the cassette lock 107 of the printer body 100. Thus, disengagement of the body engaging portion 201*a* from the cassette lock 107 can be prevented.

To increase a component of the reaction force in the direction of the body engaging portion 201*a* that is generated by elastic deformation of the elastic engaging element 214*a*, contact portions of the elastic engaging element 214*a* and the body engaging portion 201*a* that are in contact with each other have an oblique shape. Thus, the leading edge contact portion 218*a* projects from a surface 202*d* in such a manner that the leading edge contact portion 218*a* is oblique toward the side wall 202*b*. The component of the reaction force in the direction of the body engaging portion 201*a* is increased to enable the body engaging portion 201*a* to come close to the cassette lock 107 more easily, so that the body engaging portion 201*a* and the cassette lock 107 are less likely to disengage from each other to stabilize the lock of the ink ribbon cassette 200.

FIG. 9C illustrates a case in which external force is applied to the elastic engaging element 214*a* to cause the elastic engaging element 214*a* to bend toward the direction of the arrow C illustrated in FIG. 9C from the position at the time of attachment to the printer body 100 that is illustrated in FIG. 9B. In this case, the elastic engaging element 214*a* is in contact with the first side wall 202*b* forming a part of an outer periphery of the opening portion 222 of the first lower case 202. The first side wall 202*b* regulates excessive deformation of the elastic engaging element 214*a* to prevent the elastic engaging element 214*a* from being damaged or deformed. Further, since the first side wall 202*b* projects beyond the surface 202*d* of the first lower case 202 that has the opening portion 222, the first side wall 202*b* definitely comes into contact with the leading edge contact portion 218*a*, which also projects beyond the surface 202*d*. Since the first side wall 202*b* projects further than the leading edge contact portion 218*a*, the leading edge contact portion 218*a* cannot be moved to the outside the first side wall 202*b*. This arrangement prevents the situation that at the time of attaching the ink ribbon cassette 200 to the printer body 100 and then closing the cover 105, the leading edge contact portion 218*a* comes into contact with the cover 105 to make it impossible to close the cover 105.

Further, when the rotation regulation is released, the elastic engaging element 214*a* is deformed mainly from three bending points in total that are the base portion 215*a*' extending from the upper case 201, the first bending portion 226*a*, and the second bending portion 227*b*.

If the elastic engaging element 214*a* simply extends vertically from the upper case 201 without the first bending portion 220*a* and the second bending portion 221*a* being provided, when the elastic engaging element 214*a* is deformed as illustrated in FIGS. 9B and 9C, stress generated by the deformation is concentrated on the base portion. On the contrary, stress applied to the elastic engaging element 214*a* according to the present exemplary embodiment is dispersed over the three bending points so that plastic deformation to a shape formed by the bending is prevented.

As illustrated in FIGS. 9A, 9B, and 9C, the opening portion 222 is formed in a surface that faces, via the supply bobbin 205, a surface of the supply bobbin containing unit 206 to which the base portion 215*a*' is provided. Thus, the length of the arm forming the joist of the elastic engaging element 214*a* can be increased. Furthermore, since the multiple bending portions are provided closer to the base portion 215*a*' than to the engaging portion 217*a* of the elastic engaging element 214*a*, the length of the arm forming the joist can be increased even more to produce an advantage that creeping is less likely to occur.

While FIGS. 9A, 9B, and 9C illustrate the rotation regulation mechanism on the supply bobbin 205 side, a similar mechanism is also provided on the winding bobbin 207 side.

Figure 10:
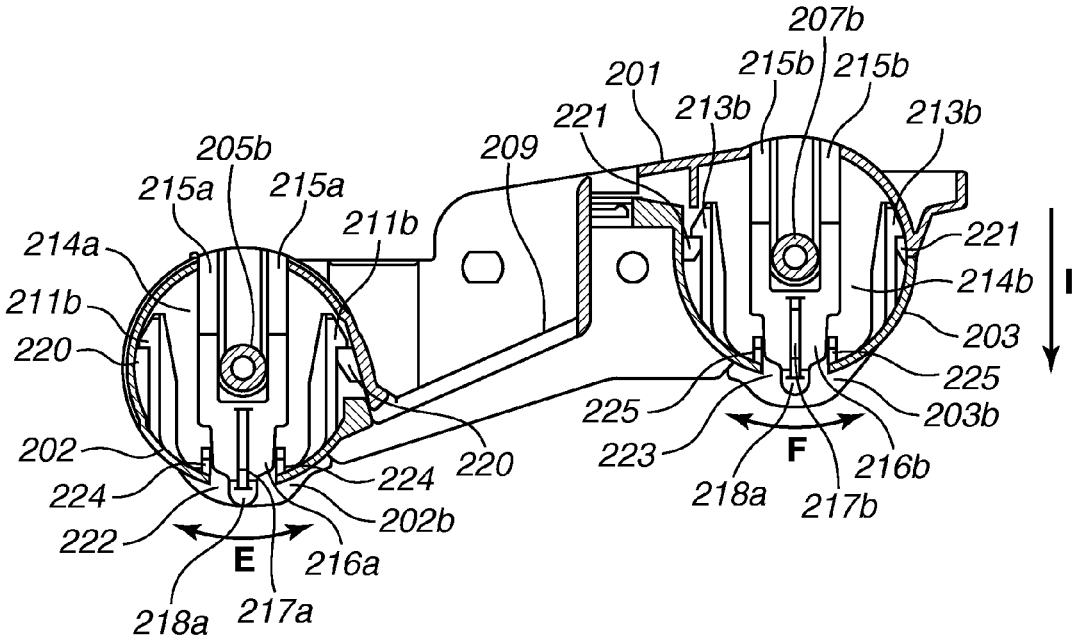
FIG. 10 is a cross sectional view illustrating the ink ribbon cassette.

FIG. 10 is a cross sectional view illustrating the ink ribbon cassette 200.

As illustrated in FIG. 10, when external rotational force is applied to the supply bobbin 205, since the rotation regulating portion 205*f* of the supply bobbin 205 is engaged with the engaging portion 217*a* of the upper case 201, the elastic engaging element 214*a* rocks in the direction of an arrow E (direction of rotation of the supply bobbin 205) illustrated in FIG. 10. At this time, a side surface of the middle portion 216*a* comes into contact with an opening portion side wall 224 inside the opening portion 222 of the first lower case 202 to regulate the rocking of the elastic engaging element 214*a*. Thus, even if strong external rotational force is applied to the supply bobbin 205, the rotation of the supply bobbin 205 can be regulated to prevent the elastic engaging element 214*a* from being damaged and the like. While the opening side wall 224 functions as an elastic engaging element regulation unit to regulate deformation of the elastic engaging element 214*a* toward the direction of the rotation of the bobbin in the present exemplary embodiment, any other member may regulate movement of the elastic engaging element 214*a* toward the direction of the rotation of the bobbin.

Similarly, when external rotational force is applied to the winding bobbin 207, since the rotation regulating portion 207*f* of the winding bobbin 207 is engaged with the engaging portion 217*b* of the upper case 201, the elastic engaging element 214*b* rocks in the direction of an arrow F (direction of rotation of the winding bobbin 207) illustrated in FIG. 10. At this time, a side surface of the middle portion 216*b* comes into contact with an opening portion side wall 225 inside the opening portion 223 of the second lower case 203 to regulate the rocking of the elastic engaging element 214*b*. Thus, even if strong external rotational force is applied to the winding bobbin 207, the rotation of the winding bobbin 207 can be regulated.

The upper case 201 includes an engaged portion 220 provided outside of the side surface of the elastic engaging element 214*a*. The engaged portion 220 is to engage with the engaging claw portion 211*b* of the first lower case 202. The upper case 201 also includes an engaged portion 221 provided outside of the side surface of the elastic engaging element 214*b*. The engaged portion 221 is to engage with the engaging claw portion 213*b* of the second lower case 203. The engaged portion of the first lower case 202 and the upper case 201 and the engaged portion of the second lower case 203 and the upper case 201 are portions reinforced by engagement. Thus, even when the elastic engaging element 214*a* is elastically deformed, the upper case 201, the first lower case 202, and the second lower case 203 are less likely to be deformed. In other words, the engaging claw portions 211*b* and 213*b* and the engaged portions 220 and 221 are disposed near the elastic engaging elements 214*a* and 214*b*, respectively, to prevent portions other than the elastic engaging elements 214*a* and 214*b* from being deformed when the elastic engaging elements 214*a* and 214*b* are elastically deformed.

Figure 11A:
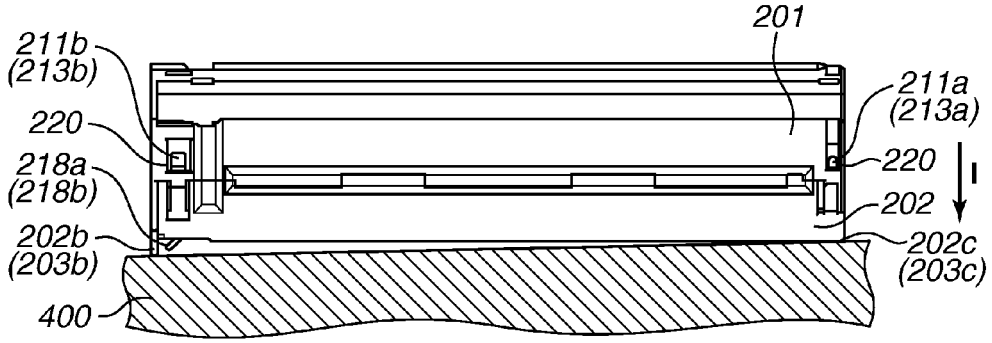
FIGS. 11A and 11B are respectively a side view and a cross sectional view illustrating the ink ribbon cassette placed on a floor surface.
Figure 11B:
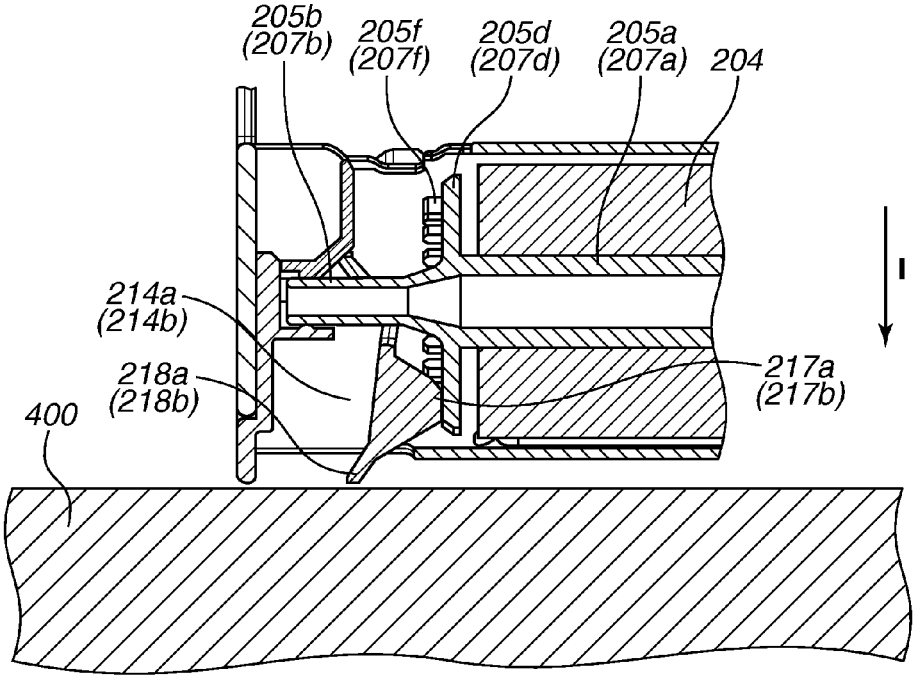

FIG. 11A is a side view illustrating the ink ribbon cassette 200 placed on the floor surface 400. FIG. 11B is a cross sectional view illustrating the ink ribbon cassette 200 placed on the floor surface 400.

As illustrated in FIG. 11A, when the ink ribbon cassette 200 is placed on the floor surface 400, which is a flat surface, the first side wall 202*b* and the first corner portion 202*c* of the first lower case 202 are in contact with the floor surface 400. While the first side wall 202*b* of the first lower case 202 is in contact with the floor surface 400, the leading edge contact portion 218*a* is not in contact with the floor surface 400, because the first side wall 202*b* of the first lower case 202 projects beyond the leading edge contact portion 218*a* in the direction of an arrow I (direction that is orthogonal to the rotation axis of the supply bobbin 205).

If the first side wall 202*b* does not project from the surface of the first lower case 202 that is parallel to the rotation axis of the supply bobbin 205, when the ink ribbon cassette 200 is placed on a flat surface such as the floor surface 400, the leading edge contact portion 218*a* comes into contact with the floor surface 400. When the leading edge contact portion 218*a* is in contact with the floor surface 400, the engaging portion 217*a* of the upper case 201 is elastically deformed due to the weight of the ink ribbon cassette 200 to disengage from the rotation regulating portion 205*f* of the supply bobbin 205, resulting in deregulation of the rotation of the supply bobbin 205. When the rotation of the supply bobbin 205 is deregulated, the supply bobbin 205 becomes freely rotatable to cause the wound ink ribbon to loosen. If the loosened ink ribbon is attached to the ink ribbon cassette insertion opening 101 of the printer body 100, the ink ribbon may be damaged, or an error may occur during the print operation. Thus, the ink ribbon cassette 200 according to the present exemplary embodiment includes the first side wall 202*b* to prevent the leading edge contact portion 218*a* from coming into contact with the floor surface 400 and also prevent releasing of the rotation regulation of the supply bobbin 205.

Further, since the ink ribbon cassette 200 is supported by the first side wall 202*b* and the first corner portion 202*c*, the first bottom surface 202*a* can be prevented from coming into contact with the floor surface 400. This can prevent a foreign substance such as dust accumulated on the floor surface 400 from adhering to the first bottom surface 202*a*.

Similarly, the second side wall 203*b* and the second corner portion 203*c* of the second lower case 203 come into contact with the floor surface 400, so that the leading edge contact portion 218*b* does not come into contact with the floor surface 400. Thus, the rotation regulation of the winding bobbin 207 is not released. Furthermore, since the ink ribbon cassette 200 is supported at two points, i.e., the second side wall 203*b* and the second corner portion 203*c*, the second bottom surface 203*a* can be prevented from coming into contact with the floor surface 400. This can prevent a foreign matter such as dust adhering to the floor surface 400 from adhering to the second bottom surface 203*a*. While FIG. 11 illustrates as an example the case in which the ink ribbon cassette 200 is placed on the floor surface 400, the same applies to the case in which the ink ribbon cassette 200 is placed on any other flat surface such as a desk.

FIGS. 12A, 12B, 13A, 13B, 14A, and 14B are cross sectional views illustrating the print operation of the printer body 100.

Figure 12A:
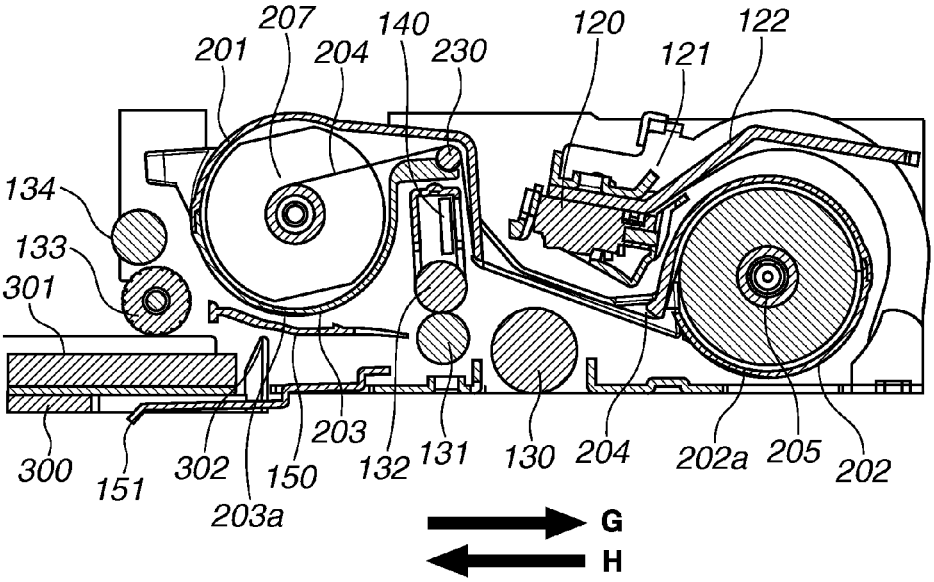
FIGS. 12A and 12B are cross sectional views illustrating a printing operation of the printer body.
Figure 12B:
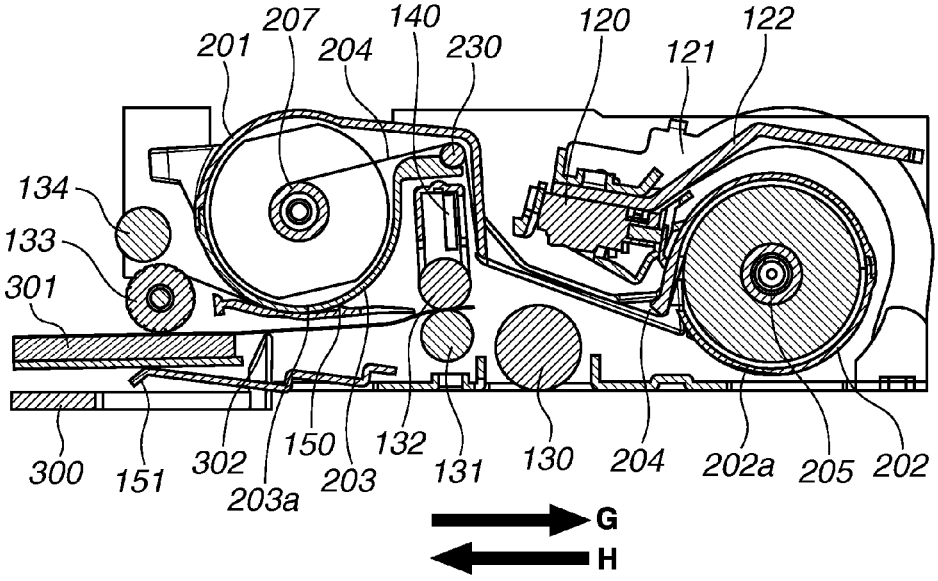
Figure 13A:
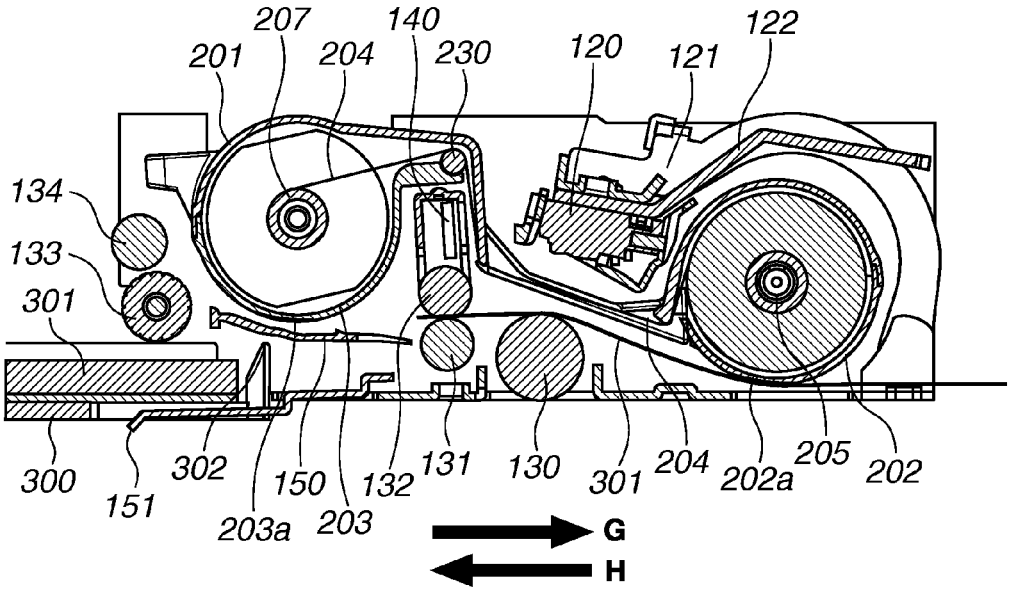
FIGS. 13A and 13B are cross sectional views illustrating a printing operation of the printer body.
Figure 13B:
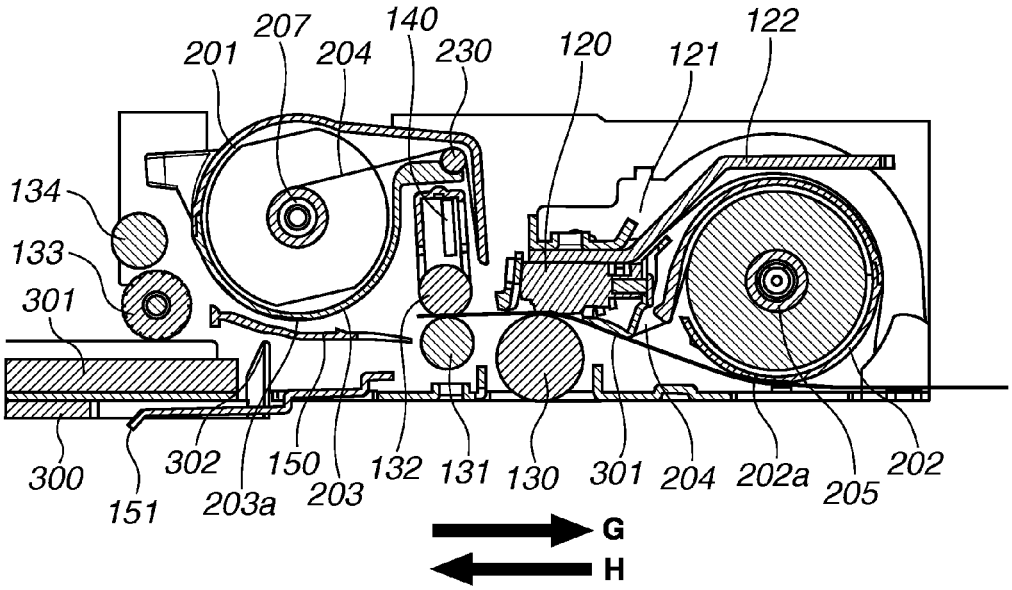
Figure 14A:
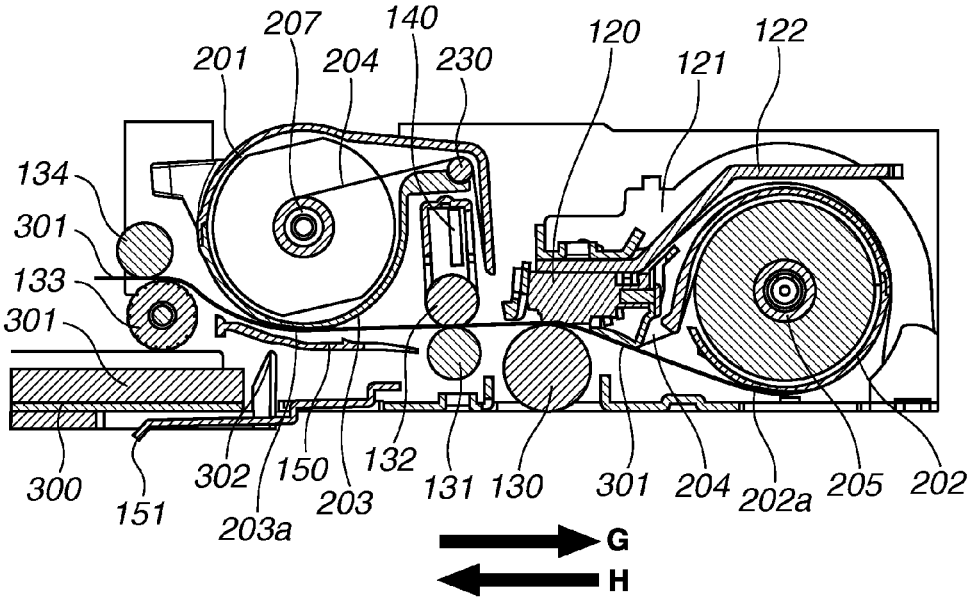
FIGS. 14A and 14B are cross sectional views illustrating a printing operation of the printer body.
Figure 14B:
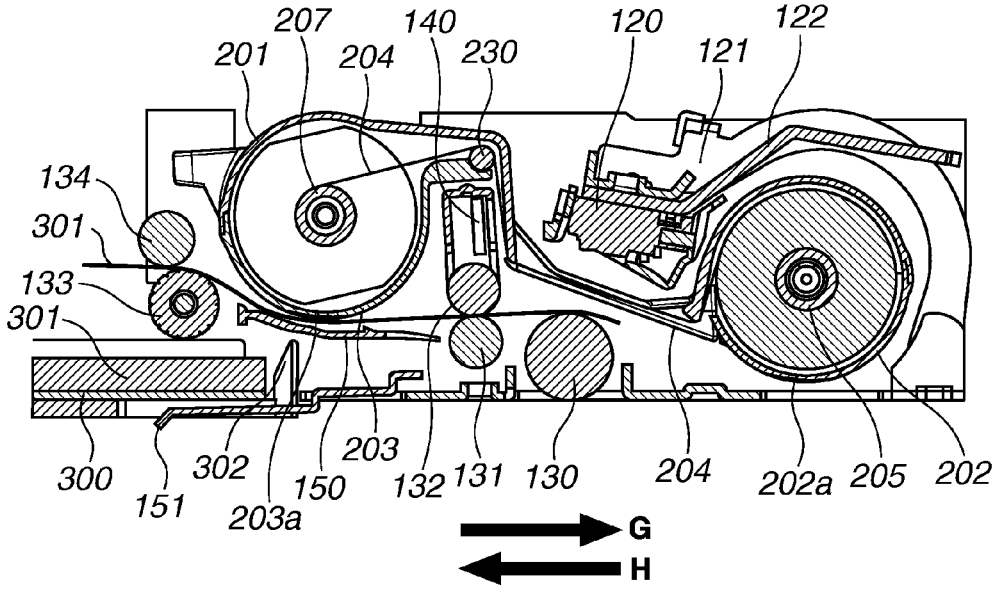

FIG. 12A is a cross sectional view illustrating a standby state. FIG. 12B is a cross sectional view illustrating a state in which a sheet 301 is fed. FIG. 13A is a cross sectional view illustrating a state in which the sheet 301 is positioned at a print start position. FIG. 13B is a cross sectional view illustrating a state before printing is started. FIG. 14A is a cross sectional view illustrating a state in which the print operation is being executed. FIG. 14B is a cross sectional view illustrating a state in which the printing is finished.

FIG. 12A includes a thermal head 120, a thermal head supporting arm 121, a heat sink 122, and a platen roller 130. The thermal head supporting arm 121 is supported pivotally around a pivot (not illustrated). The thermal head 120 is supported by the thermal head supporting arm 121, is pivotable from the position illustrated in FIG. 12A to the position illustrated in FIG. 13B, and can generate contact pressure between the thermal head 120 and the platen roller 130. The heat sink 122 is attached to the thermal head 120, and heat generated at the thermal head 120 can be moved to the heat sink 122. The platen roller 130 is rotatably provided to the printer body 100 and is configured to rotate according to conveyance of the sheet 301.

A conveyance roller 131 and a driven roller 132 are also provided. The conveyance roller 131 is driven by a sheet conveyance motor (not illustrated) to be rotated. The driven roller 132 is a driven roller facing the conveyance roller 131 and is configured to rotate following the rotation of the conveyance roller 131.

A sheet feeding roller 133 and a sheet discharging roller 134 are also provided. The sheet feeding roller 133 is driven by a sheet feed driving motor (not illustrated) to be rotated. The sheet discharging roller 134 is a driven roller facing the sheet feeding roller 133 and is configured to rotate following the sheet feeding roller 133.

A sheet guide 150 is also provided. The sheet guide 150 is pushed upward by the sheet 301 when the sheet 301 is fed. The sheet guide 150 is supported so as to be pivotable from the position illustrated in FIG. 12A to the position illustrated in FIG. 12B. The sheet guide 150 is always biased downward and is at the position illustrated in FIG. 12A. A pressurization plate 151 is pivotably driven by a driving source (not illustrated) and is pivotable from the position illustrated in FIG. 12A to the position illustrated in FIG. 12B.

The print operation of the printer body 100 will be described below.

When the ink ribbon cassette 200 is attached to the printer body 100 via the ink ribbon cassette insertion opening 101, the contact surfaces 110*a* and 110*b* of the printer body 100 come into contact with the leading edge contact portions 218*a* and 218*b* of the ink ribbon cassette 200, respectively, as illustrated in FIG. 9B. The elastic engaging elements 214*a* and 214*b* are bent to the position illustrated in FIG. 9B to disengage the engaging portions 217*a* and 217*b* of the ink ribbon cassette 200 from the rotation regulating portion 205*f* of the supply bobbin 205 and the rotation regulating portion 207*f* of the winding bobbin 207. As a result of this disengagement, the supply bobbin 205 and winding bobbin 207 become rotatable, so that the supply bobbin 205 and the winding bobbin 207 can rotatably be driven by a rotation driving mechanism (not illustrated) provided to the printer body 100.

If the user operates the operation unit 104 to give a print instruction, the pressurization plate 151 is rotatably driven by a driving source (not illustrated) so that the sheet 301 stored in the sheet tray 300 is brought into contact with the sheet feeding roller 133, as illustrated in FIG. 12B. Then, the sheet feeding roller 133 is rotatably driven by a sheet feeding driving source (not illustrated), so that the sheet 301 is fed from the sheet tray 300. At this time, a leading edge of the sheet 301 comes into contact with the sheet separating unit 302, so that only an uppermost sheet 301 can be separated and fed. Then, the sheet 301 is conveyed while pushing the sheet guide 150 upward.

When the sheet 301 is conveyed to a nip portion of the conveyance roller 131 and the driven roller 132 illustrated in FIG. 12B, a sheet conveyance motor (not illustrated) is rotated to drive the conveyance roller 131. The conveyance roller 131 conveys the sheet 301 toward the direction of an arrow G illustrated in FIG. 12B so that the sheet 301 is passed between the thermal head 120 and the platen roller 130.

Next, as illustrated in FIG. 13A, the sheet 301 is conveyed to a print start position while being in contact with and guided by the first bottom surface 202*a* of the ink ribbon cassette 200. When the sheet 301 arrives at the print start position, yellow printing is started first to execute printing.

First, a driving source (not illustrated) pivot the thermal head supporting arm 121 to move the thermal head 120 from a retracting position illustrated in FIG. 13A to the print position illustrated in FIG. 13B, rest the thermal head 120 at the print position, and press the sheet 301 with the thermal head 120 and the platen roller 130. Then, the conveyance roller 131 conveys the sheet 301 toward the direction of an arrow H illustrated in FIG. 13B, and a heating element of the thermal head 120 generates heat in response to a print signal from a control device (not illustrated) to thermally transfer a yellow dye on the ink ribbon 204 onto the sheet 301, whereby yellow printing is executed.

During the print operation, the sheet 301 is conveyed while a print surface of the sheet 301 is in contact with and guided by the first bottom surface 202*a* and the second bottom surface 203*a* of the ink ribbon cassette 200, as illustrated in FIG. 14A.

During the print operation, a driving source (not illustrated) rotationally drives the winding bobbin 207 to convey the ink ribbon 204 together with the sheet 301 at the same conveyance speed toward the direction of an arrow H illustrated in FIG. 14A. The ink ribbon 204 is conveyed while being in contact with a shaft 230, which is freely rotatably held by the ink ribbon cassette 200, so that the conveyance resistance of the ink ribbon 204 can be reduced to prevent a print defect such as wrinkles due to defective conveyance of the ink ribbon 204.

When the yellow printing is completed, a return operation is executed to execute the next magenta printing. First, the thermal head supporting arm 121 is pivoted to release the press of the thermal head 120 and the platen roller 130, and to rest the thermal head 120 and the platen roller 130 at retracting positions illustrated in FIG. 14B, respectively. The thermal head 120 is separated from the platen roller 130, so that the sheet 301 and the ink ribbon 204 can be conveyed separately. The conveyance roller 131 conveys the sheet 301 toward the direction of an arrow G to the print start position illustrated in FIG. 13A while bringing the sheet 301 into contact with the first bottom surface 202*a* of the ink ribbon cassette 200 and guiding the sheet 301.

At the same time, in order to start the next magenta printing, the winding bobbin 207 is rotated so that a magenta print start position of the ink ribbon 204 is adjusted to a position facing the thermal head 120, and then the ink ribbon 204 is drawn from the supply bobbin 205.

When the sheet 301 is conveyed to the print start position, and the head of the ink ribbon 204 is positioned at the magenta print start position, the return operation ends, and the magenta printing is started.

In the magenta printing, as in the yellow printing, a driving source (not illustrated) pivots the thermal head supporting arm 121 to rest the thermal head 120 at the position illustrated in FIG. 13B, and the sheet 301 and the ink ribbon 204 are pressed by the thermal head 120 and the platen roller 130. Then, the conveyance roller 131 conveys the sheet 301 toward the direction of an arrow H illustrated in FIG. 13B while the heating element of the thermal head 120 generates heat in response to a print signal from the control device (not illustrated) to thermally transfer a magenta dye on the ink ribbon 204 onto the sheet 301, whereby the magenta printing is executed.

Thereafter, the return operation is executed as in the yellow printing. This is followed by cyan printing similar to the yellow printing and the magenta printing, whereby a color image is printed on the sheet 301.

The printer body 100 according to the present exemplary embodiment executes overcoat printing after the three-color printing to prevent an image printed on the sheet 301 from deteriorating due to an external factor.

In the overcoat printing, as in the yellow printing, first the return operation is executed to convey the sheet 301 to the print start position. When the head of the ink ribbon 204 is positioned at an overcoat print start position, the return operation ends, and the overcoat printing is started.

The overcoat printing is executed similarly to the yellow printing. First, the driving source pivots the thermal head supporting arm 121 to rest the thermal head 120 at the position illustrated in FIG. 13B, and the sheet 301 and the ink ribbon 204 are pressed by the thermal head 120 and the platen roller 130. Then, while the conveyance roller 131 conveys the sheet 301 toward the direction of the arrow H illustrated in FIG. 13B, the heating element of the thermal head 120 generates heat in response to a print signal from the control device (not illustrated) to thermally transfer an overcoat layer on the ink ribbon 204 onto the sheet 301.

When the overcoat printing (transfer) is completed, in order to discharge the sheet 301, the printer body 100 rotationally drives the sheet feeding roller 133 to nip the sheet 301 with the sheet feeding roller 133 and the sheet discharging roller 134, conveys the sheet 301 toward the direction of the arrow H, and discharges the sheet 301 to the outside of the printer body 100.

In this way, the first bottom surface 202*a* and the second bottom surface 203*a* of the ink ribbon cassette 200 form a part of the conveyance path of the sheet 301 in the print operation of the printer body 100. Thus, if a foreign substance such as dust is attached to the first bottom surface 202*a* or the second bottom surface 203*a*, the foreign substance such as dust may adhere to the print surface of the sheet 301 during the print operation, and the dyes are not transferred onto the sheet 301 to result in omission of colors and the like.

However, as described above, when the ink ribbon cassette 200 according to the present exemplary embodiment is placed on the floor surface 400, the first bottom surface 202*a* and the second bottom surface 203*a* do not come into contact with the floor surface 400, so that adhesion of a foreign substance such as dust can be prevented.

Figure 16:
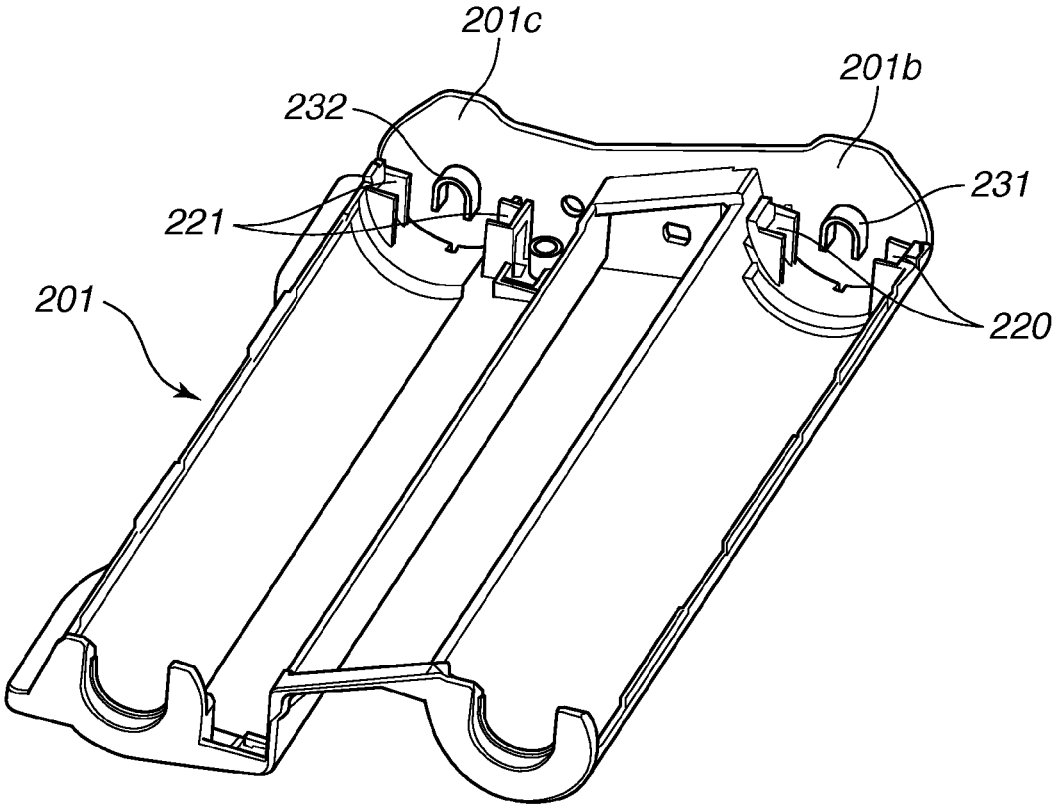
FIG. 16 is a perspective view illustrating an upper case according to the second exemplary embodiment.
Figure 17:
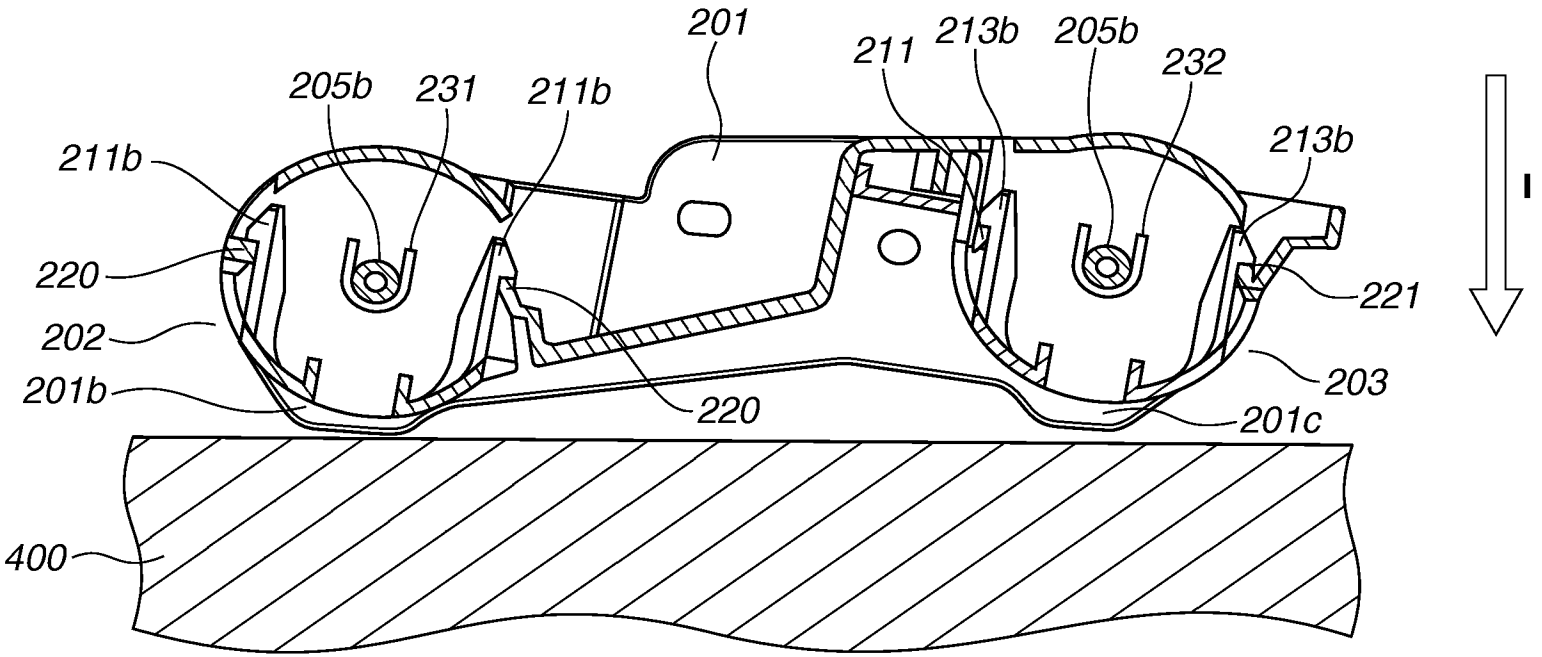
FIG. 17 is a cross sectional view illustrating the ink ribbon cassette according to the second exemplary embodiment.

A second exemplary embodiment will be described with reference to FIGS. 15 to 17.

The basic structure is similar to that of the first exemplary embodiment, so that only different points will be described below.

Figure 15:
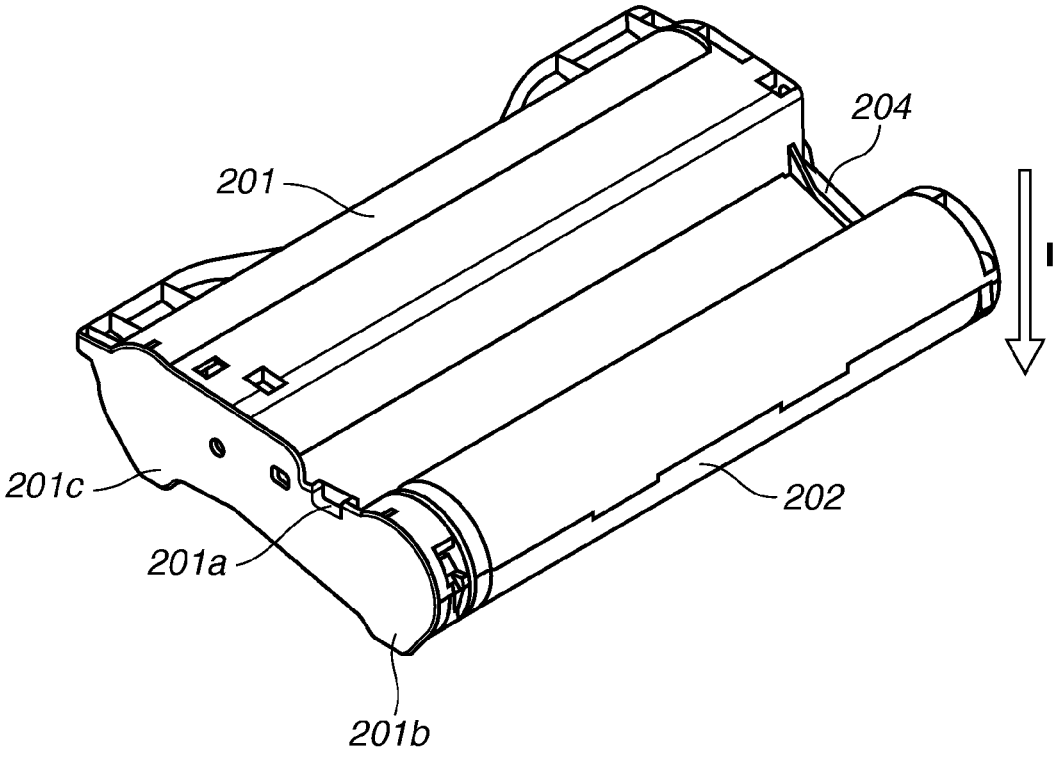
FIG. 15 is a perspective view illustrating an ink ribbon cassette according to a second exemplary embodiment.

FIG. 15 is a perspective view illustrating an ink ribbon cassette 200 according to the second exemplary embodiment. FIG. 16 is a perspective view illustrating an upper case 201 according to the second exemplary embodiment. FIG. 17 is a cross sectional view illustrating the ink ribbon cassette 200 according to the second exemplary embodiment. To simplify the description, the elastic engaging elements 214*a* and 214*b* are omitted in FIGS. 16 and 17.

To simplify the description, elements that are similar to those of the first exemplary embodiment are given the same reference numerals.

As illustrated in FIG. 15, a side wall of the upper case 201 of the ink ribbon cassette 200 includes a first projecting portion 201*b* and a second projecting portion 201*c*. As illustrated in FIGS. 16 and 17, the upper case 201 includes bearing portions 231 and 232, which pivotally support the supply bobbin 205 and the winding bobbin 207. The bearing portions 231 and 232 support the first projecting portion 201*b* side and the second projecting portion 201*c* side of the supply bobbin 205 and the winding bobbin 207, respectively.

Further, engaged portions 220 and 221 are provided near the first projecting portion 201*b*, the second projecting portion 201*c*, the bearing portions 231 and 232, and the engaging claw portions 211*b* and 213*b* of the upper case 201. The engaged portions 220 and 221 respectively engage with the engaging claw portion 211*b* of the first lower case 202 and the engaging claw portion 213*b* of the second lower case 203, whereby the ink ribbon cassette 200 is formed.

A case in which the ink ribbon cassette 200 falls, will be described.

If the ink ribbon cassette 200 falls in a direction of an arrow I illustrated in FIG. 15, a large load is applied to the bearing portions 231 and 232, which bear the weight of the ink ribbon 204, and the projecting portions 201*b* and 201*c*, which are in contact with the floor surface 400. Thus, when the ink ribbon cassette 200 falls, the load is more likely to apply to the engaging claw portions 211*b* and 213*b*, and the engaged portions 220 and 221 provided near the bearing portions 231 and 232, and the projecting portions 201*b* and 201*c*. Especially the engaging claw portions 211*b* and 213*b* are easily deformed, so that if a large load is applied to the engaging claw portions 211*b* and 213*b*, the engaging claw portions 211*b* and 213*b* are likely to disengage. In view of the foregoing, the ink ribbon cassette 200 according to the present exemplary embodiment is arranged to reduce the load applied to the engaging claw portions 211*b* and 213*b* when the ink ribbon cassette 200 falls, so that the engaging claw portions 211*b* and 213*b* are less likely to disengage.

The arrangement for reducing the load applied to the engaging claw portions 211*b* and 213*b* when the ink ribbon cassette 200 falls, will be described with reference to FIG. 17.

When the ink ribbon cassette 200 falls, the first projecting portion 201*b* and the second projecting portion 201*c* of the upper case 201 come into contact with the floor surface 400. At this time, the load of the ink ribbon 204 is applied in the direction of the arrow I illustrated in FIG. 15 to the bearing portions 231 and 232 supporting the projecting portions 201*b* and 201*c* sides of the axes of the supply bobbin 205 and the winding bobbin 207. The load applied by the ink ribbon 204 is also passed to the first projecting portion 201*b* and the second projecting portion 201*c* provided to the components to which the bearing portions 231 and 232 are provided. Since the bearing portions 231 and 232 are provided to the upper case 201, the load applied to the engaging claw portion 211*b* of the first lower case 202 and the engaging claw portion 213*b* of the second lower case 203 can be reduced.

Further, when the ink ribbon cassette 200 falls, the first projecting portion 201*b* and the second projecting portion 201*c* come into contact with the floor surface 400 to be subjected to the load of the ink ribbon cassette 200. The first projecting portion 201*b* and the second projecting portion 201*c* are also provided to the upper case 201, so that the load applied to the engaging claw portion 211*b* of the first lower case 202 and the engaging claw portion 213*b* of the second lower case 203 can also be reduced.

As described above, according to the present exemplary embodiment, the projecting portions 201*b* and 201*c* and the bearing portions 231 and 232 to which the load is to be applied are provided to the case that is different from the case to which the engaging claw portions 211*b* and 213*b* are provided. This reduces the load applied to the engaging claw portions 211*b* and 213*b*, so that disengagement of the first lower case 202 and the second lower case 203 of the upper case 201 can be prevented.

(Other Exemplary Embodiments)

While the exemplary embodiments have been described, it is to be understood that the present invention is not limited to the exemplary embodiments and can be modified and changed in various ways within the spirit of the invention.

While the ink ribbon cassette 200 is formed by engagement of the upper case 201 with the first lower case 202 and the second lower case 203 in the foregoing exemplary embodiments, the ink ribbon cassette 200 is not limited to those described above. For example, the ink ribbon cassette 200 may be formed by the upper case 201 and a lower case in which the first lower case 202 and the second lower case 203 are integrally formed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-183963 filed Sep. 5, 2013, No. 2013-183964 filed Sep. 5, 2013, No. 2013-183965 filed Sep. 5, 2013, and No. 2013-183966 filed Sep. 5, 2013, which are hereby incorporated by reference herein in their entirety.

What is claimed is:

1. An ink ribbon cassette comprising:

a supply bobbin around which an ink ribbon is wound;

a winding bobbin configured to wind the ink ribbon supplied by the supply bobbin;

a housing configured to support the supply bobbin and the winding bobbin in such a manner that the supply bobbin and the winding are substantially parallel to each other and are rotatable; and an engaging member configured to engage with a rotation regulating portion of the supply bobbin or a rotation regulating portion of the winding bobbin to regulate rotation of the supply bobbin or the winding bobbin, and to be elastically deformable in a direction of rotation axes of the supply bobbin and the winding bobbin.

2. The ink ribbon cassette according to claim 1, further comprising a regulating portion configured to regulate deformation of the engaging member in a direction of the rotation of the supply bobbin or the winding bobbin.

3. The ink ribbon cassette according to claim 1, wherein the housing includes an opening portion, and wherein a leading edge of the engaging member projects outward from the housing through the opening portion.

4. The ink ribbon cassette according to claim 3, wherein when the ink ribbon cassette is attached to a printer apparatus, the leading edge of the engaging member comes into contact with a part of the printer apparatus to deregulate the rotation of the supply bobbin or the winding bobbin.

5. The ink ribbon cassette according to claim 3, wherein the housing of the ink ribbon cassette is formed by engagement of a plurality of cases, and wherein the case including the engaging member is different from the case including the opening portion.

6. The ink ribbon cassette according to claim 5, wherein the engaging member is provided near an engaging portion configured to engage the plurality of cases.

7. The ink ribbon cassette according to claim 1, further comprising a side wall portion, which is a surface of the housing that is substantially orthogonal to the rotation axis of the supply bobbin, configured to regulate elastic deformation of the engaging member when the engaging member is elastically deformed in the direction of the rotation axes.

8. A printer apparatus to which the ink ribbon cassette according to claim 7 is attachable, wherein a contact portion to be in contact with the leading edge of the engaging member is provided to an insertion opening in which the ink ribbon cassette is to be inserted.

9. The ink ribbon cassette according to claim 1, wherein the engaging member projects from a surface of the housing that is substantially parallel to the rotation axis of the supply bobbin, and wherein a side wall portion, which is a surface of the housing that is substantially orthogonal to the supply bobbin, projects beyond the engaging member.

10. The ink ribbon cassette according to claim 9, wherein the surface of the housing that is substantially parallel to the supply bobbin includes an opening portion, and wherein the engaging member projects through the opening portion.

11. The ink ribbon cassette according to claim 10, wherein the side wall portion projects beyond the engaging member from the surface including the opening portion.

12. The ink ribbon cassette according to claim 10, wherein the opening portion is formed near the side wall portion.

13. The ink ribbon cassette according to claim 1, wherein a leading edge of the engaging member has an oblique shape and projects obliquely from a surface of the housing that is substantially parallel to the supply bobbin.

14. The ink ribbon cassette according to claim 1, wherein the ink ribbon cassette is attachable to and removable from a printer including a cassette lock configured to engage with a side wall of the ink ribbon cassette to hold the ink ribbon cassette attached to the printer, and wherein the engaging member has an oblique shape so that reaction force generated by elastic deformation of the engaging member when the ink ribbon cassette is attached to the printer to cause a leading edge of the engaging member to come into contact with a contact surface of the printer is directed toward the cassette lock.

15. The ink ribbon cassette according to claim 1, wherein the housing includes a bearing portion configured to support the rotation axis of the supply bobbin or the winding bobbin, wherein a leading edge of the engaging member is configured to project from a surface of the housing that is substantially parallel to the rotation axis of the supply bobbin, and wherein a side wall, which is a surface of the housing that is substantially orthogonal to the supply bobbin, includes a projecting portion projecting beyond the leading edge of the engaging member.

16. The ink ribbon cassette according to claim 15, wherein the housing includes at least a first case and a second case and is formed by engagement of an engaged portion provided to the first case with an engaging claw portion provided to the second case, and wherein the bearing portion is provided to the first case.

17. The ink ribbon cassette according to claim 16, wherein the projecting portion is provided to the first case, and wherein the bearing portion supports the rotation axis of the supply bobbin or the winding bobbin on the projecting portion side.

18. The ink ribbon cassette according to claim 16, wherein an engaging portion including the engaged portion and the engaging claw portion is provided near the bearing portion.

19. The ink ribbon cassette according to claim 16, wherein an engaging portion including the engaged portion and the engaging claw portion is provided near the projecting portion.

20. The ink ribbon cassette according to claim 19, wherein the engaging member is formed to rise from a surface, which forms the containing unit configured to contain the supply bobbin or the winding bobbin, of the housing towards an inside of a containing unit.

21. The ink ribbon cassette according to claim 20, wherein a surface of the containing unit that is opposite, via the rotation axis of the supply bobbin or the winding bobbin, to a base portion of the engaging member rising from the surface forming the containing unit includes an opening through which a leading edge of the engaging member projects outward from the housing.

22. The ink ribbon cassette according to claim 21, wherein the engaging member includes a plurality of bending portions, and wherein the plurality of bending portions are provided closer to the base portion than to an engaging portion configured to engage with the rotation regulating portion.

23. The ink ribbon cassette according to claim 22, wherein the engaging member includes an arm portion having a two-pronged shape, and the rotation axis of the supply bobbin or the winding bobbin is disposed in a space portion in the two-pronged shape of the arm portion, and wherein the arm portion includes the plurality of bending portions.

24. The ink ribbon cassette according to claim 1, wherein the engaging member is formed integrally with the housing.

25. The ink ribbon cassette according to claim 1, wherein the engaging member includes a plurality of bending portions.

26. The ink ribbon cassette according to claim 1, wherein the engaging member includes an arm portion having a two-pronged shape, and the rotation axis of the supply bobbin or the winding bobbin is positioned in a space portion between the two prongs of the arm portion.

27. A printer to which an ink ribbon cassette is attachable, the printer comprising:

an ink ribbon cassette including a supply bobbin around which an ink ribbon is wound, a winding bobbin configured to wind the ink ribbon supplied by the supply bobbin, a housing configured to support the supply bobbin and the winding bobbin so that the supply bobbin and the winding are substantially parallel to each other and are rotatable, and an engaging member elastically deformable in a direction of rotation axes of the supply bobbin and the winding bobbin and configured to engage with a rotation regulating portion of the supply bobbin or a rotation regulating portion of the winding bobbin to regulate rotation of the supply bobbin or the winding bobbin;

an insertion opening to allow the ink ribbon cassette to be attached or removed in the direction of the rotation axis of the supply bobbin; and a contact portion configured to come into contact with the engaging member when the ink ribbon cassette is attached to the printer so that the engaging member is elastically deformed to disengage from the supply bobbin or the winding bobbin, to release regulation of the rotation of the supply bobbin or the winding bobbin, wherein the engaging member projects from a surface of the housing that is substantially parallel to the rotation axis of the supply bobbin, and wherein a side wall portion, which is a surface of the housing that is substantially orthogonal to the supply bobbin, projects beyond the engaging member.

28. The printer according to claim 27, further comprising a cassette lock configured to engage with the side wall portion to hold the ink ribbon cassette attached to the printer, wherein a leading edge of the engaging member that projects from the housing has an oblique shape, and wherein the cassette lock is provided in a direction in which reaction force is generated by the elastic deformation when the ink ribbon cassette is attached.

29. The printer according to claim 28, wherein the contact portion and the cassette lock are provided at the insertion opening, and the cassette lock is provided on a side opposite to the contact portion.

30. The printer according to claim 28, wherein the cassette lock is biased toward the leading edge of the engaging member.

* * * * *